US009177516B2

(12) United States Patent
Iwasa

(10) Patent No.: US 9,177,516 B2
(45) Date of Patent: Nov. 3, 2015

(54) DESCRIPTION LIQUID CRYSTAL DISPLAY DEVICE AND PIXEL INSPECTION METHOD THEREFOR

(71) Applicant: JVC KENWOOD Corporation, Yokohama-shi (JP)

(72) Inventor: Takayuki Iwasa, Yokohama (JP)

(73) Assignee: JVC KENWOOD Corporation, Yokohama-shi (JP)

( * ) Notice: Subject to any disclaimer, the term of this patent is extended or adjusted under 35 U.S.C. 154(b) by 0 days.

(21) Appl. No.: 14/289,523

(22) Filed: May 28, 2014

(65) Prior Publication Data

US 2014/0267200 A1 Sep. 18, 2014

Related U.S. Application Data

(63) Continuation of application No. PCT/JP2012/076863, filed on Oct. 17, 2012.

(30) Foreign Application Priority Data

Dec. 1, 2011 (JP) ..... 2011-263329

(51) Int. Cl.
*G09G 3/36* (2006.01)
*G09G 3/00* (2006.01)
*G09G 3/20* (2006.01)

(52) U.S. Cl.
CPC ..... *G09G 3/3611* (2013.01); *G09G 3/006* (2013.01); *G09G 3/2022* (2013.01); *G09G 3/36* (2013.01); *G09G 3/3648* (2013.01); (Continued)

(58) Field of Classification Search
CPC ..... G09G 3/36; G09G 3/006; G09G 3/2022; G09G 3/3648; G09G 3/3611; G09G 2300/0857; G09G 2310/0251; G09G 2300/0426
USPC ..... 345/87–100, 204–215
See application file for complete search history.

(56) References Cited

U.S. PATENT DOCUMENTS 6,127,700 A * 10/2000 Bulucea ..... 257/335
6,985,201 B2 * 1/2006 Iwasa et al. ..... 349/137
(Continued)

FOREIGN PATENT DOCUMENTS

JP 01-094391 A 4/1989
JP 06-102530 A 4/1994
(Continued)

OTHER PUBLICATIONS

International Search Report and Written Opinion in PCT International Application No. PCT/JP2012/076863, Jan. 15, 2013.

*Primary Examiner* — Vijay Shankar
(74) *Attorney, Agent, or Firm* — Venable LLP; Michael A. Sartori

(57) ABSTRACT

A liquid crystal display device includes an inspection control unit configured to alternately perform a first inspection operation in which an inspection signal is input from a first column data line connected to one pixel of the two pixels in each of the pairs into the one pixel and is read out to a second column data line connected to another pixel through the other pixel of the two pixels in each of the pairs and a second inspection operation in which an inspection signal is input from the second column data line into the other pixel and is read out to the first column data line through the one pixel, on all of the plurality of pixels in a unit of pixels in each row when the pixels being inspected.

6 Claims, 9 Drawing Sheets

(52) U.S. Cl.
CPC ..... *G09G 2300/0426* (2013.01); *G09G 2300/0857* (2013.01); *G09G 2310/0251* (2013.01)

(56) References Cited

U.S. PATENT DOCUMENTS

2002/0036625 A1 3/2002 Nakamura
2002/0075211 A1 6/2002 Nakamura
2009/0219238 A1* 9/2009 Furuya et al. ..... 345/87

FOREIGN PATENT DOCUMENTS

JP 2001-523847 A 11/2001
JP 2002-175040 A 6/2002
WO WO-99/26226 A1 5/1999

* cited by examiner

DESCRIPTION LIQUID CRYSTAL DISPLAY DEVICE AND PIXEL INSPECTION METHOD THEREFOR

CROSS-REFERENCE TO RELATED APPLICATIONS

This application is a continuation of International Application No. PCT/JP2012/076863, filed on Oct. 17, 2012 which claims the benefit of priority of the prior Japanese Patent Application No. 2011-263329, filed on Dec. 1, 2011, the entire contents of which are incorporated herein by reference.

BACKGROUND OF THE INVENTION

1. Field of the Invention

The present invention relates to a liquid crystal display device and a pixel inspection method therefor, and more particularly to a liquid crystal display device and a pixel inspection method therefor that perform gray scale display using the combination of a plurality of subframes according to gray scale levels expressed by a plurality of bits.

2. Description of the Related Art

Heretofore, a subframe driving method is known as one of halftone display methods in liquid crystal display devices. In a subframe driving method which is one type of time base modulation methods, a predetermined period (one frame that is a unit for display of one image in the case of moving pictures, for example) is split into a plurality of subframes, and pixels are driven in a combination of subframes according to a gray scale to be displayed. The gray scale to be displayed is determined according to the ratio of a pixel drive period occupied in a predetermined period, and this ratio is specified by the combination of subframes.

In liquid crystal display devices according to this subframe driving method, one is known in which pixels are individually configured of a master latch, a slave latch, a liquid crystal display element, and first to third switching transistors, three transistors in total (see Japanese Patent Application National Publication (Laid-Open) No. 2001-523847, for example). In this pixel, one bit of a first data is applied to one input terminal of two input terminals of the master latch through the first switching transistor, a second data in the complementary relation with the first data is applied to the other input terminal through the second switching transistor, and when the pixel is selected by a row select signal applied through a row scanning line, the first data is written as the first and second switching transistors are turned to the ON-state. For example, when the first data has the logical value "1" and the second data has the logical value "0", the pixel performs display.

After the data is written to all the pixels through the similar operations described above, the data written to the master latch are simultaneously read to the slave latch as the third switching transistors of all the pixels are turned to the ON-state in the subframe period, and the data latched to the slave latch are applied from the slave latch to the pixel electrode of the liquid crystal display element. The operations above are then repeated for the individual subframes, and desired gray scale display is performed with the combinations of all the subframes in a frame period.

Namely, in the liquid crystal display device according to the subframe driving method, all of the subframes in a frame period are preallocated to the same predetermined period or a different predetermined period. In the pixels, display is performed on all the subframes in the maximum gray scale display, display is not performed on all the subframes in the minimum gray scale display, and subframes for display are selected according to the gray scale for display in the case of the other gray scales. In the previously existing liquid crystal display device, inputted data is digital data expressing a gray scale, and the method is also a digital driving method in a two-stage latch configuration.

However, in the previously existing liquid crystal display device, since the two latches in the pixels are configured of static random access memories (SRAM), the number of transistors is increased and it is difficult to downsize the pixels.

Moreover, in the pixel above, generally, a silicon backplane including shift registers, for example, is prepared in large-scale semiconductor integrated circuit (LSI) processes. However, in probe inspection after a wafer is prepared, there is a problem that pixel inspection is not performed normally. This is because there is a possibility that the SRAM is rewritten due to electric charges accumulated on a column data line. Because when the pixel inspection is performed, data written to the SRAM is read out from the column data line after the data is input to the column data line and the input data is written to the SRAM.

In the description of Japanese Patent Application National Publication (Laid-Open) No. 2001-523847, a two-switch SRAM including two complementary bit lines is described. In contrast to this, here, the case of a one-switch SRAM configured of a single bit line and a single switch is considered.

For example, in the case of a full high definition (FHD) liquid crystal display device, the number of pixels lengthwise on the screen is 1,080 pixels, and the capacitance of the individual column data lines is about 1 pF. For example, an SRAM is configured of a switching transistor connected to a column data line at zero volt at low level and two inverters in which an input terminal of one inverter is connected to an output terminal of the other inverter. In these two inverters, suppose that the voltage of the input terminal of the one inverter connected to the switching transistor is at high level at a voltage of 3.3 V. In this case, when the switching transistor is turned on, the column data lines are charged at about 1 pF of electric charge capacitance described above from a P-channel MOS field effect transistor (in the following, referred to as a P-MOS transistor) configuring the other inverter whose output terminal is connected to the switching transistor.

At this time, since the driving force of the transistor configuring the other inverter is smaller than the driving force of the transistor configuring the one inverter, charging time is prolonged to cause incomplete charging, the voltage of the input terminal of the one inverter is below the turnover voltage, and the voltage (namely, data that has to be written to the SRAM) of the input terminal of the one inverter is rewritten. Thus, data on the SRAM is not enabled to be output to the column data line, and pixels are not accurately inspected.

The present invention is made on the viewpoints above, and it is an object to provide a liquid crystal display device and a pixel inspection method therefor that can downsize a pixel as compared with a pixel using two SRAMs in the pixel and can accurately inspect pixels.

SUMMARY OF THE INVENTION

There is a need to at least partially solve the problems in the conventional technology.

According to one aspect of the present invention, provided is a liquid crystal display device including: a plurality of pixels configured to be provided at an intersecting portion at which a plurality of column data lines intersects with a plurality of row scanning lines, in which two adjacent pixels that are connected to a same row scanning line are paired, each of the two pixels of each pairs individually including: a display element configured to be filled and seal with liquid crystal between a pixel electrode and a common electrode opposite to each other; a first switching unit configured to be connected to the row scanning line and configured to sample each subframe data for displaying each of a plurality of subframes having a display period shorter than one frame period of the video signal through the column data line when selecting a row, the plurality of subframes being for displaying one frame; a first signal holding unit configured to form a static random access memory together with the first switching unit and configured to store the subframe data sampled by the first switching unit; the display element, the first switching unit, and the first signal holding unit being provided separately in each of the pixels in the pair; and a second switching unit configured to connect or disconnect a connecting point between the first signal holding unit and the pixel electrode in the two pixels, the second switching unit being provided commonly in each of the pairs; a switching control unit configured to control the second switching unit to be turned off when writing and reading the pixels and control the second switching unit to be turned on when inspecting the pixels; a pixel control unit configured to perform, when writing and reading the pixels, for each of the subframe, an operation in which the subframe data is written into the first signal holding unit for each of the pixels per row in the plurality of pixels configuring the image display unit and the written data is applied to the pixel electrode; and an inspection control unit configured to alternately perform a first inspection operation in which an inspection signal is input from a first column data line connected to one pixel of the two pixels in each of the pairs into the one pixel and is read out to a second column data line connected to another pixel through the other pixel of the two pixels in each of the pairs and a second inspection operation in which an inspection signal is input from the second column data line into the other pixel and is read out to the first column data line through the one pixel, on all of the plurality of pixels in a unit of pixels in each row when the pixels being inspected.

Further, according to another aspect of the present invention, provided is a pixel inspection method for a liquid crystal display device including a plurality of pixels configured to be provided at an intersecting portion at which a plurality of column data lines intersects with a plurality of row scanning lines, in which two adjacent pixels that are connected to a same row scanning line are paired, each of the two pixels of each pairs individually including: a display element configured to be filled and seal with liquid crystal between a pixel electrode and a common electrode opposite to each other; a first switching unit configured to be connected to the row scanning line and configured to sample each subframe data for displaying each of a plurality of subframes having a display period shorter than one frame period of the video signal through the column data line when selecting a row, the plurality of subframes being for displaying one frame; a first signal holding unit configured to form a static random access memory together with the first switching unit and configured to store the subframe data sampled by the first switching unit; the display element, the first switching unit, and the first signal holding unit being provided separately in each of the pixels in the pair; and a second switching unit configured to connect or disconnect a connecting point between the first signal holding unit and the pixel electrode in the two pixels, the second switching unit being provided commonly in each of the pairs, in inspecting the pixels of the liquid crystal display device, the method including: controlling the second switching unit to be turned on; and alternately performing a first inspection operation in which an inspection signal is input from a first column data line connected to one pixel of the two pixels in each of the pairs into the one pixel and is read out to a second column data line connected to another pixel through the other pixel of the two pixels in each of the pairs and a second inspection operation in which an inspection signal is input from the second column data line into the other pixel and is read out to the first column data line through the one pixel, on all of the plurality of pixels in a unit of pixels in each rows.

The above and other object, feature, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

In the following, embodiments of the present invention will be described with reference to the drawings.

Figure 1:
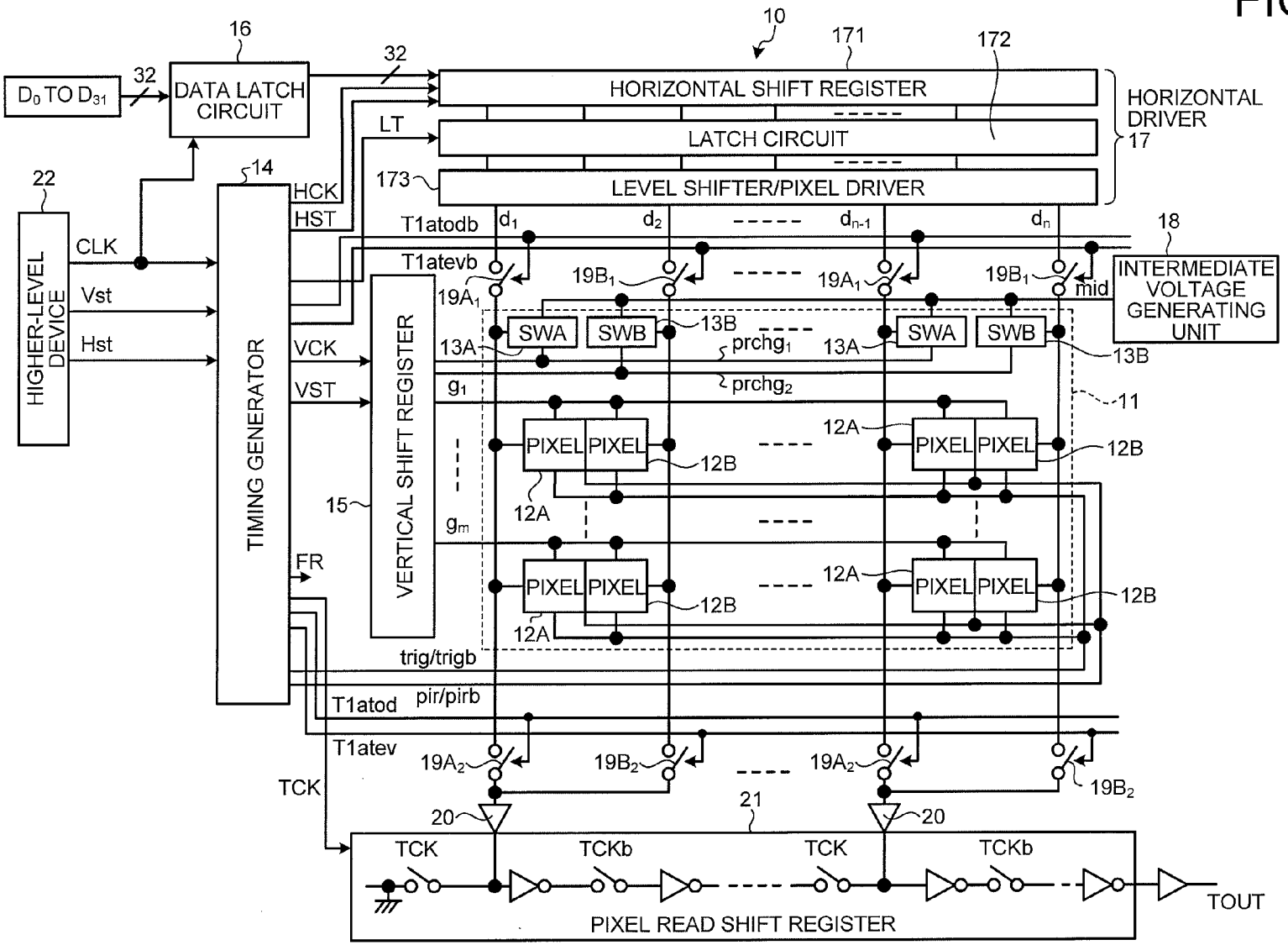
FIG. 1 is a diagram of the overall structure of an embodiment of a liquid crystal display device according to embodiments.

FIG. 1 is a block diagram of a liquid crystal display device applicable to the embodiments. In FIG. 1, a liquid crystal display device 10 according to the embodiment is configured to include an image display unit 11 including a plurality of pixels 12A and pixels 12B regularly arranged, a switch 13A (SWA) and a switch 13B (SWB), a timing generator 14, a vertical shift register 15, a data latch circuit 16, a horizontal driver 17, an intermediate voltage generating unit 18 that outputs a predetermined intermediate voltage to an interconnection mid, an input switch (a write-side switch) 19$A_1$ and an output switch (a read-side switch) 19$A_2$ connected to an odd-numbered column data line $d_{od}$ (od=1, 3, to n−1), an input switch (a write-side switch) 19$B_1$ and an output switch (a read-side switch) 19$B_2$ connected to an even-numbered column data line $d_{ev}$ (ev=2, 4, to n), a buffer amplifier 20, and a pixel read shift register 21. The horizontal driver 17 is configured of a horizontal shift register 171, a latch circuit 172, and a level shifter/pixel driver 173. Moreover, the pixel read shift register 21 is a shift register having a capacitance for the number of pixels half of the number of pixels in one row.

The image display unit 11 includes (m×n)/a pair of the pixel 12A and the pixel 12B arranged in a two-dimensional matrix configuration and provided at intersecting portions at which m (m is two or more of natural numbers) row scanning lines $g_1$ to $g_m$ and n (n is two or more of natural numbers) column data lines $d_1$ to $d_n$ in which one end of the row scanning line is connected to the vertical shift register 15 and the row scanning line extends in the row direction (in the X-direction) and one end of the column data line is connected to the level shifter/pixel driver 173 and the column data line extends in the column direction (in the Y-direction). The pixel 12A and the pixel 12B are two adjacent pixels connected to the same row scanning line. These two adjacent pixels 12A and 12B are provided with a single shared switch, described later. The embodiments are characterized in the circuit configurations of the pixel 12A and the pixel 12B, and the embodiments will be described later. All the pixels 12A and 12B in the image display unit 11 are connected in common to trigger lines trig and trigb whose one end is connected to the timing generator 14 and to inspection control lines pir and pirb.

A forward trigger pulse that the forward trigger pulse trigger line trig transmits and a reverse trigger pulse that the reverse trigger pulse trigger line trigb transmits are in the relation of reverse logical values (in the complementary relation) all the time. Similarly, a forward inspection control signal that the inspection control line pir transmits and a reverse inspection signal that the inspection control line pirb transmits are in the relation of reverse logical values (in the complementary relation). However, both of the forward inspection control signal and the reverse inspection control signal are fixed to predetermined logical values in the general read and write of the pixels, and used only in the inspection of the pixels.

The timing generator 14 receives external signals such as a vertical synchronization signal Vst, a horizontal synchronization signal Hst, and a basic clock CLK as input signals from a higher-level device 22, and generates various internal signals such as an alternating signal FR, a V-start pulse VST, a H-start pulse HST, clock signals VCK and HCK, a latch pulse LT, a trigger pulse, an inspection control signal, and switch control signals Tlatod, Tlatodb, Tlatev, and Tlatevb based on these external signals.

In the internal signals above, the alternating signal FR is a signal whose polarity is inverted for every subframe, and is supplied as a common electrode voltage Vcom, described later, to the common electrode of the liquid crystal display element in the pixel 12A and the pixel 12B configuring the image display unit 11. The start pulse VST is a pulse signal outputted at the start timing of subframes, described later, and the start pulse VST controls switching between subframes. The start pulse HST is a pulse signal outputted at the start timing at which the signal is inputted to the horizontal shift register 171. The clock signal VCK is a shift clock that regulates one horizontal scanning period (one H) in the vertical shift register 15, and the vertical shift register 15 performs the shift operation at the timing of the VCK. The clock signal HCK is a shift clock in the horizontal shift register 171, and is a signal for shifting data in 32-bit duration.

The latch pulse LT is a pulse signal outputted at the timing at which the horizontal shift register 171 finishes shifting data of pixels on one line in the horizontal direction. Moreover, the timing generator 14 supplies the forward trigger pulse to all the pixels 12A and 12B in the image display unit 11 through the trigger line trig and supplies the reverse trigger pulse through trigb. The forward trigger pulse and the reverse trigger pulse are outputted immediately after data is in turn written to a first signal holding unit in the pixels 12A and 12B in the image display unit 11 in a subframe period for transferring data in the first signal holding units of all the pixels 12A and 12B in the image display unit 11 to a second signal holding unit in the same pixel at one time in the subframe period.

Moreover, the timing generator 14 outputs the forward inspection control signal to the switch shared by the adjacent pixels 12A and 12B through the inspection control line pir and the reverse inspection control signal through the inspection control line pirb. Furthermore, the timing generator 14 outputs the control signals Tlatodb and Tlatevb to fix the input switches 19$A_1$ and 19$B_1$ to the ON-state in the general read and write of the pixels, and controls one of the input switches 19$A_1$ and 19$B_1$ to be turned on and the other to be turned off in the inspection of the pixels. In addition, the timing generator 14 outputs the control signals Tlatod and Tlatev to fix the output switches 19$A_2$ and 19$B_2$ to the OFF-state in the general read and write of the pixels, and controls one of the output switches 19$A_2$ and 19$B_2$ to be turned on and the other to be turned off in the inspection of the pixels.

The vertical shift register 15 transfers the V-start pulse VST supplied at the beginning of subframes according to the clock signal VCK, exclusively in turn supplies the row scanning signal to the row scanning lines $g_1$ to $g_m$ per horizontal scanning period, and supplies the row scanning signal to all the row scanning lines $g_1$ to $g_m$ in one frame period. Thus, in one frame period, the row scanning line is in turn selected one by one per horizontal scanning period from the uppermost row scanning line $g_1$ to the undermost row scanning line $g_m$ in the image display unit 11.

The data latch circuit 16 latches data in 32-bit duration split for every one subframe supplied from an external circuit, not illustrated, based on the basic clock CLK from the higher-level device 22, and outputs the data to the horizontal shift register 171 in synchronization with the basic clock CLK. Here, in the first embodiment, one frame of a video signal is split into a plurality of subframes in a display period shorter than one frame period of the video signal, and gray scale display is performed according to the combination of subframes. Thus, in the first embodiment, the external circuit described above converts gray scale data expressing the gray scale for individual pixels of the video signal into one-bit subframe data in units of subframes for displaying the gray scale of the pixels in a plurality of the overall subframes. The external circuit described above then supplies 32 pixels of the subframe data in the same subframe together as the data in 32-bit duration to the data latch circuit 16.

In the case where the horizontal shift register 171 is considered in the process system of one bit serial data, the horizontal shift register 171 starts shifting by the H-start pulse HST supplied from the timing generator 14 at the beginning of one horizontal scanning period, and shifts data in 32-bit duration supplied from the data latch circuit 16 in synchronization with the clock signal HCK. The latch circuit 172 latches n bits of data supplied in parallel from the horizontal shift register 171 (namely, n pixels of subframe data in the same row) according to the latch pulse LT supplied from the timing generator 14 at the point in time at which the horizontal shift register 171 finishes shifting n bits of data the same as a row of the pixel number n in the image display unit 11, and outputs the data to the level shifter of the level shifter/pixel driver 173. When data transfer to the latch circuit 172 is finished, the H-start pulse is again outputted from the timing generator 14, and the horizontal shift register 171 again starts shifting data in 32-bit duration from the data latch circuit 16 according to the clock signal HCK.

The level shifter of the level shifter/pixel driver 173 level-shifts the signal level of data in n subframes corresponding to a row of n pixels latched and supplied from the latch circuit 172 to the liquid crystal drive voltage. The pixel driver of the level shifter/pixel driver 173 outputs data in n subframes corresponding to a row of n pixels after level-shifted in parallel with n column data lines $d_1$ to $d_n$.

The horizontal shift register 171, the latch circuit 172, and the level shifter/pixel driver 173 configuring the horizontal driver 17 perform the output of data to a row of pixels to which data is written this time in one horizontal scanning period in parallel with shifting data related to a row of pixels to which data is written in the subsequent horizontal scanning period. In a certain horizontal scanning period, the latched data in n subframes of a row is simultaneously outputted as data signals in parallel with n column data lines $d_1$ to $d_n$.

Here, the column data lines $d_1$ to $d_n$ are used in units of two adjacent column data lines in the inspection of the pixels. Suppose that one odd-numbered column data line is $d_{od}$ and the other even-numbered column data line is $d_{ev}$ in the two adjacent column data lines, the column data line $d_{od}$ supplies the data signal from the level shifter/pixel driver 173 to the pixel 12A in the image display unit 11 through the input switch 19$A_1$, and supplies the inspection signal outputted from the pixel 12A through the column data line $d_{od}$ to the output switch 19$A_2$. Moreover, the column data line $d_{ev}$ supplies the data signal from the level shifter/pixel driver 173 to the pixel 12B in the image display unit 11 through the input switch 19$B_1$, and supplies the inspection signal outputted from the pixel 12B through the column data line $d_{ev}$ to the output switch 19$B_2$.

In a plurality of the pixels 12A and 12B configuring the image display unit 11, a row of n/2 of the pixels 12A and the pixels 12B selected by the row scanning signal from the vertical shift register 15 sample a row of data in n subframes simultaneously outputted from the level shifter/pixel driver 173 through n data lines $d_1$ to $d_n$ and the input switches 19$A_1$ and 19$B_1$, and write the data to the first signal holding units, described later, in the pixels 12A and the pixels 12B.

Next, the pixel 12A and the pixel 12B, which are the essential part of the liquid crystal display device according to each of the embodiments, will be described in detail.

Figure 2:
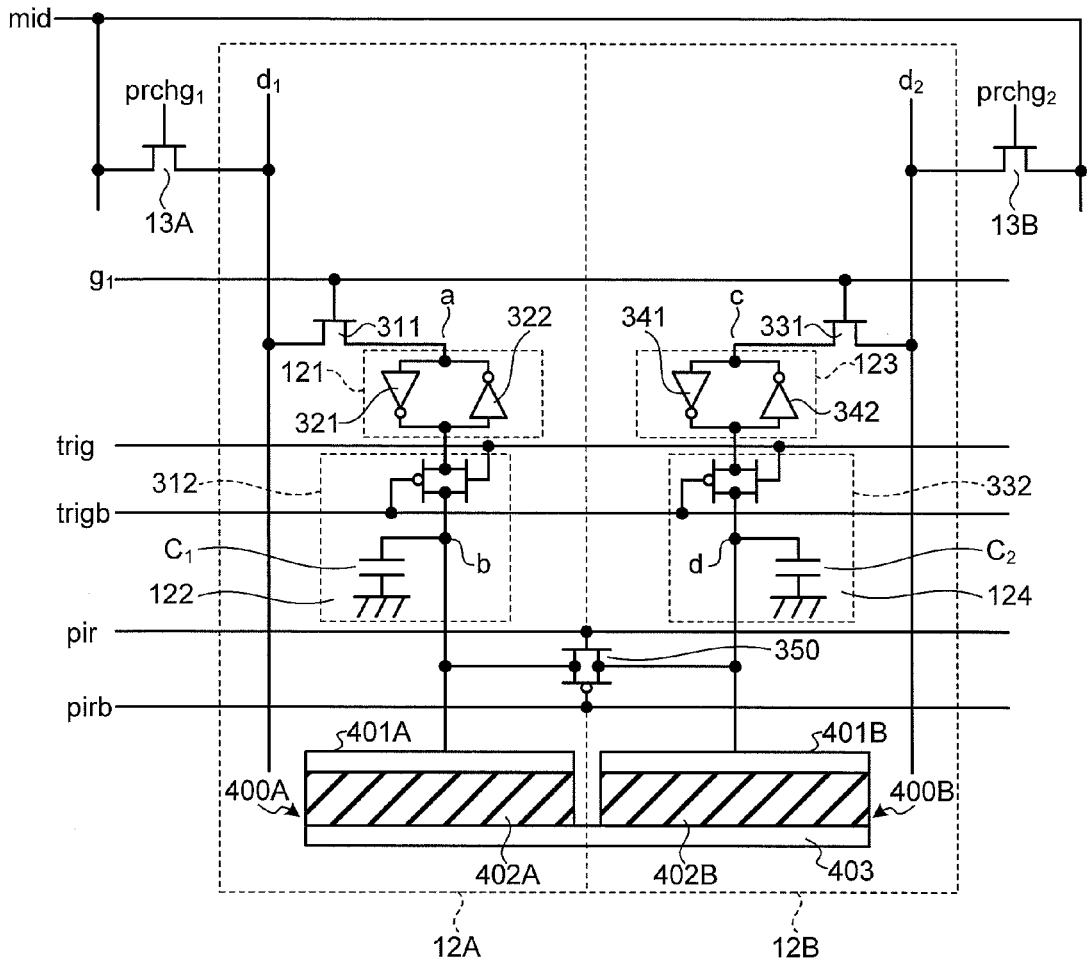
FIG. 2 is a circuit diagram of two adjacent pixels connected to the same row scanning line in a liquid crystal display device according to a first embodiment.

Next, the first embodiment will be described. FIG. 2 illustrates the equivalent circuit of the pixel, which is the essential part of the liquid crystal display device according to the first embodiment, together with surrounding circuits. In FIG. 2, the pixel 12A and the pixel 12B are two pixels connected to a given same row scanning line g in FIG. 1 and adjacent to each other in the column direction, in which the pixel 12A is provided at the intersecting portion of a given column data line $d_1$ (this line is the column data line $d_{od}$ as well) and one row scanning line g and the pixel 12B is provided at the intersecting portion of the column data line $d_2$ (this line is the column data line $d_{ev}$ as well) adjacent to the column data line $d_1$ and the row scanning line g. Moreover, the intermediate voltage, described later, is supplied to the pixel 12A through the first switch 13A and the column data line $d_1$. The intermediate voltage is supplied to the pixel 12B through the second the switch 13B and the column data line $d_2$. The switches 13A and 13B are each configured of one switching transistor.

The pixel 12A includes a static random access memory (SRAM) configured of a switch 311 configuring a first switching unit and a first signal holding unit (SM) 121, a dynamic random access memory (DRAM) 122 configured of a switch 312 configuring a second switching unit and a capacitance $C_1$ that is a second signal holding unit, and a liquid crystal display element 400A. Moreover, the pixel 12B includes a static random access memory (SRAM) configured of a switch 331 configuring a first switching unit and a first signal holding unit (SM) 123, a dynamic random access memory (DRAM) 124 configured of a switch 332 configuring a second switching unit and a capacitance $C_2$ that is a second signal holding unit, and a liquid crystal display element 400B. Furthermore, the pixel 12A and the pixel 12B share a switch 350 configuring a third switching unit. The liquid crystal display elements 400A and 400B are in a publicly known structure in which liquid crystals 402A and 402B are filled and sealed in a space between a common electrode 403 of optical transparency and reflecting electrodes 401A and 401B that are pixel electrodes provided apart from each other and opposite to each other and having light reflection characteristics.

The switches 311 and 331 are each configured of one N-channel MOS transistor (in the following, referred to as an NMOS transistor) in which the gates are connected to the row scanning line g in common, the drains are separately connected to the column data lines $d_1$ and $d_2$, and the sources are separately connected to the input terminals of the SMs 121 and 123. The SM 121 is a self-holding memory formed of two inverters 321 and 322 in which an output terminal of one inverter is connected to an input terminal of the other inverter. Similarly, the SM 123 is a self-holding memory formed of two inverters 341 and 342 in which an output terminal of one inverter is connected to an input terminal of the other inverter.

In the inverter 321, the input terminal is connected to the output terminal of the inverter 322 and the source of the NMOS transistor configuring the switch 311. The input terminal of the inverter 322 is connected to the switch 312 and the output terminal of the inverter 321. Similarly, in the inverter 341, the input terminal is connected to the output terminal of the inverter 342 and the source of the NMOS transistor configuring the switch 331. In the inverter 342, the input terminal is connected to the switch 332 and the output terminal of the inverter 341.

Figure 3:
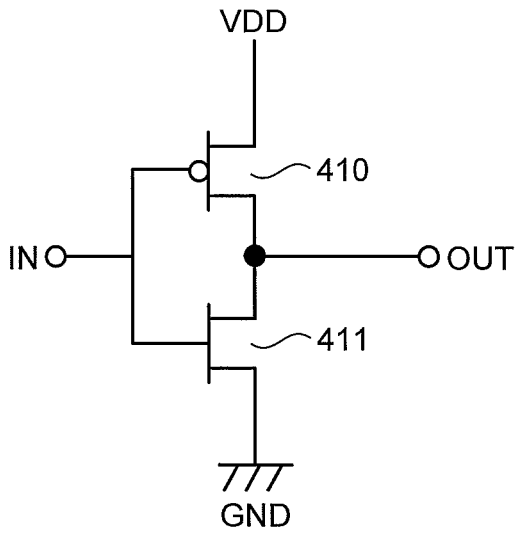
FIG. 3 is an exemplary circuit diagram of an inverter according to the first embodiment.

Any of the inverters 321, 322, 341 and 342 are in a publicly known CMOS inverter configuration formed of a P-channel MOS transistor (in the following, referred to as a P-MOS transistor) 410 and an NMOS transistor 411 as illustrated in FIG. 3, in which the gates of the transistors are connected to each other and the drains are connected to each other. However, the driving forces of the transistors are different.

Namely, for the transistors in the inverters 321 and 341 on the input side configuring the SM 121 and the SM 123 when seen from the switches 311 and 331, such a transistor is used whose driving force is greater than the driving force of the transistors in the inverters 322 and 342 on the output side configuring the SM 121 and the SM 123 when seen from the switches 311 and 331. Moreover, for the driving forces of the NMOS transistors configuring the switches 311 and 331, such a transistor is used whose driving force is greater than the driving forces of the NMOS transistors configuring the inverters 322 and 342.

This is because it is necessary that electric currents carried through the switches 311 and 331 be greater than electric currents carried through the NMOS transistors configuring the transistors on the output side of the inverters 322 and 342 in order that voltages on the input side of the switches 311 and 331 at "H" level reach a voltage or more at which the transistors on the input side of the inverters 321 and 341 are inverted. Therefore, it is necessary to determine the transistor sizes of the NMOS transistors configuring the switches 311 and 331 and the transistor sizes of the NMOS transistors configuring the inverters 322 and 342 in consideration that the driving forces of the NMOS transistors configuring the switches 311 and 331 are formed greater than the driving forces of the NMOS transistors configuring the inverters 322 and 342.

The switches 312 and 332 are in the publicly known transmission gate configuration formed of an NMOS transistor and a P-MOS transistor in which the drains of the transistors are connected to each other and the sources are connected to each other. The gate of the NMOS transistor is connected to the forward trigger pulse trigger line trig, and the gate of the P-MOS transistor is connected to the reverse trigger pulse trigger line trigb.

Moreover, in the switches 312 and 332, one terminal is connected to the SM 121 and the SM 123, and the other terminal is connected to the capacitance $C_1$ and the capacitance $C_2$ and the reflecting electrodes 401A and 401B of the liquid crystal display elements 400A and 400B. Therefore, the switches 312 and 332 are turned on when the forward trigger pulse supplied through the trigger line trig is at "H" level (at this time, the reverse trigger pulse supplied through the trigger line trigb is at "L" level), and read and transfer data stored on the SM 121 and the SM 123 to the capacitances $C_1$ and $C_2$ and the reflecting electrodes 401A and 401B. Furthermore, the switches 312 and 332 are turned off when the forward trigger pulse supplied through the trigger line trig is at "L" level (at this time, the reverse trigger pulse supplied through the trigger line trigb is at "H" level), and do not read data stored on the SM 121 and the SM 123.

The switches 312 and 332 are in the publicly known transmission gate configuration, so that voltages ranging from the GND to the VDD can be turned on and off. In other words, when the signals applied to the gates of the NMOS transistor and the P-MOS transistor configuring the transmission gate are at the GND-side potential (at "L" level), the NMOS transistor can be conducted at low resistance instead that the P-MOS transistor is not enabled to be conducted. On the other hand, when the signals inputted to the gates are at the VDD-side potential (at "H" level), the P-MOS transistor can be conducted at low resistance instead that the NMOS transistor is not enabled to be conducted. Therefore, the transmission gate configuring the switches 312 and 332 is controlled to be turned on/off using the forward trigger pulse supplied through the trigger line trig and the reverse trigger pulse supplied through the trigger line trigb, so that the voltage range of the GND to the VDD can be switched at low resistance and high resistance.

The capacitance $C_1$ configures the DRAM 122 together with the switch 312, and the capacitance $C_2$ configures the DRAM 124 together with the switch 332. Here, in the case where data stored on the SM 121 and the SM 123 is different from data held on the capacitance $C_1$ and the capacitance $C_2$, the switches 312 and 332 are turned on, and when data stored on the SM 121 and the SM 123 is transferred to the capacitance $C_1$ and the capacitance $C_2$, it is necessary to replace data held on the capacitance $C_1$ and the capacitance $C_2$ with data stored on the SM 121 and the SM 123.

In the case where data held on the capacitance $C_1$ and the capacitance $C_2$ is rewritten, the held data is changed by charging or discharging, and charging and discharging the capacitance $C_1$ are driven by the output signal of the inverter 321, and charging and discharging the capacitance $C_2$ are driven by the output signal of the inverter 341. In the case where data held on the capacitance $C_1$ and the capacitance $C_2$ is rewritten from "L" level to "H" level by charging, the output signals of the inverters 321 and 341 are at "H". At this time, the P-MOS transistor (410 in FIG. 3) configuring the inverter 321 and 341 is turned on, the NMOS transistor (411 in FIG. 3) is turned off, and thus the capacitance $C_1$ and the capacitance $C_2$ are charged by the power supply voltage VDD connected to the sources of the P-MOS transistors of the inverters 321 and 341.

On the other hand, in the case where data held on the capacitance $C_1$ and the capacitance $C_2$ is rewritten from "H" level to "L" level by discharging, the output signals of the inverters 321 and 341 are at "L" level. At this time, the NMOS transistor (the NMOS transistor 411 in FIG. 3) configuring the inverters 321 and 341 is turned on, the P-MOS transistor (the P-MOS transistor 410 in FIG. 3) is turned off, and thus electric charges accumulated on the capacitance $C_1$ and the capacitance $C_2$ are discharged to the GND through the NMOS transistor (411 in FIG. 3) of the inverters 321 and 341. The switches 312 and 332 are in the analog switch configuration using the transmission gate described above, so that it is possible to charge and discharge the capacitance $C_1$ and the capacitance $C_2$ described above at high speed.

Moreover, in the first embodiment, the driving forces of the inverters 321 and 341 are set greater than the driving forces of the inverters 322 and 342, so that it is possible to drive the charging and discharging of the capacitance $C_1$ and the capacitance $C_2$ at high speed. Furthermore, when the switches 312 and 332 are turned on, the electric charges accumulated on the capacitance $C_1$ and the capacitance $C_2$ also affect the input gates of the inverters 322 and 342. However, since the driving forces of the inverters 321 and 341 are set greater than the driving forces of the inverters 322 and 342, charging and discharging the capacitance $C_1$ and the capacitance $C_2$ by the inverters 321 and 341 are performed prior to inverting data input by the inverters 322 and 342, and data stored on the SM 121 and the SM 123 is not rewritten.

The switch 350 is in the publicly known transmission gate configuration formed of an NMOS transistor and a P-MOS transistor in which the drains of the transistors are connected to each other and the sources are connected to each other. The gate of the NMOS transistor that is the control terminal of the transmission gate configuring the SW 3 is connected to a forward inspection control signal interconnection pir, and the gate of the P-MOS transistor is connected to a reverse inspection control signal interconnection pirb. Moreover, the drains (or the sources) of the NMOS transistor and the P-MOS transistor, which are one terminal of two terminals of the transmission gate configuring the SW 3, are connected to the capacitance $C_1$ and the reflecting electrode 401A, and the sources of (or the drains) of the NMOS transistor and the P-MOS transistor, which are the other terminal, are connected to the capacitance $C_2$ and the reflecting electrode 401B.

In accordance with the pixel 12A and the pixel 12B according to the first embodiment illustrated in FIG. 2, as described above, it is possible to set a higher applied voltage of the liquid crystal display elements 400A and 400B, and it is possible to obtain a great effect that pixels can be downsized as well as the effect that a wide dynamic range can be provided. These two pixels 12A and 12B can be downsized because the pixels 12A and 12B are configured of 16 transistors in total and two capacitances $C_1$ and $C_2$ as illustrated in FIG. 2, and the pixels can be configured using component elements fewer than the component elements of two previously existing pixels. In addition to this reason, as described in the following, this is because the SM 121, the SM 123, the DRAMs 122 and 124, and the reflecting electrodes 401A and 401B can be effectively disposed in the height direction of the element.

Figure 4:
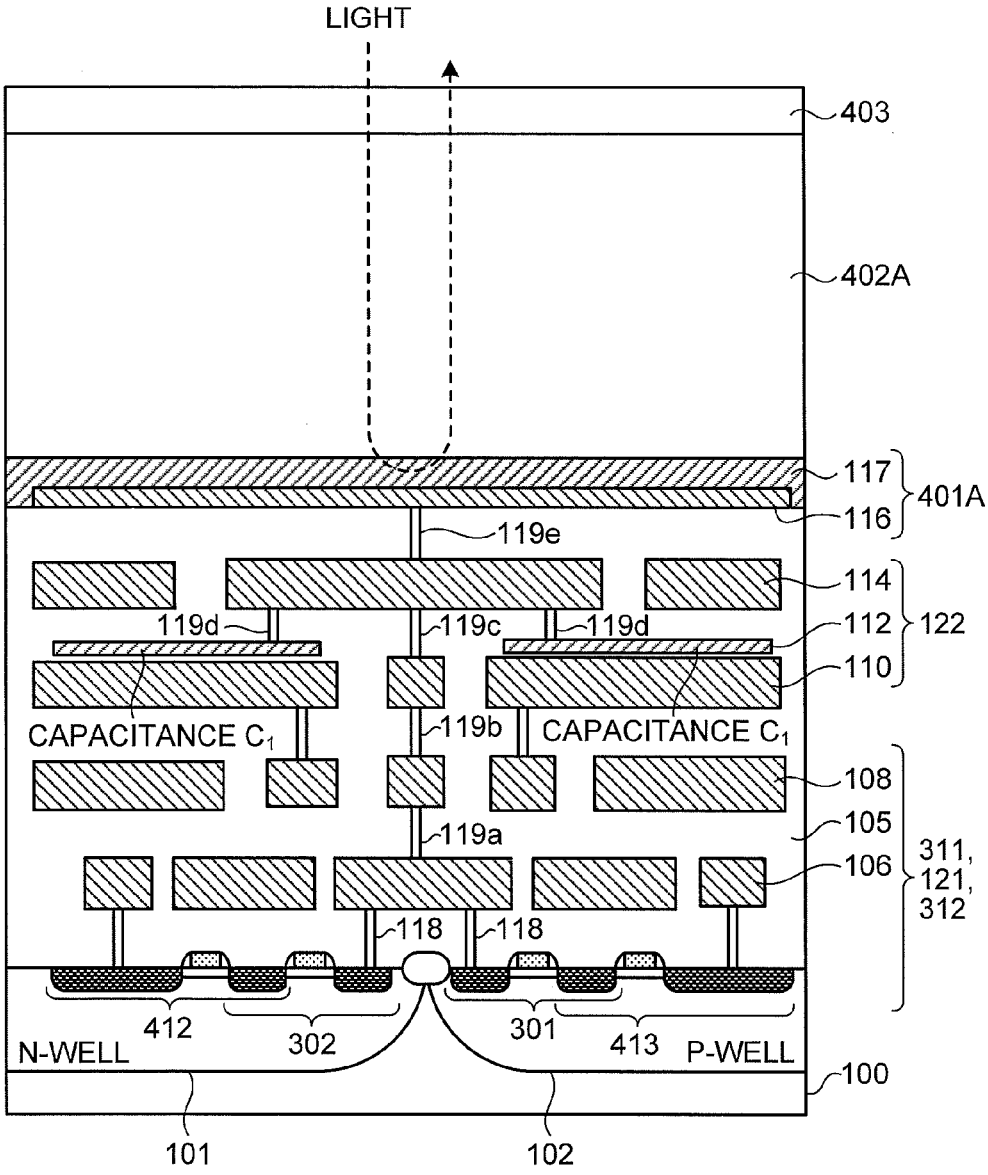
FIG. 4 is a structural diagram of an exemplary cross section of a pixel according to the first embodiment illustrated in FIG. 2.

FIG. 4 is a cross sectional block diagram of the essential part of the pixel of the liquid crystal display device applicable to the embodiments. For the capacitance $C_1$ and the capacitance $C_2$ illustrated in FIG. 2, such capacitances can be used including a MIM (Metal-Insulator-Metal) capacitance forming a capacitance between the interconnections, a Diffusion capacitance forming a capacitance between a substrate and polysilicon, and a PIP (Poly-Insulator-Poly) capacitance forming a capacitance between polysilicon in two layers. FIG. 4 is a cross sectional block diagram of a liquid crystal display device in the case where the capacitance $C_1$ is configured of a MIM. It is noted that FIG. 4 is a cross sectional view of a partial configuration of the pixel 12A.

In FIG. 4, the P-MOS transistor 412 of the inverter 321 and the P-MOS transistor 302 of the switch 312 are formed on an N-well 101 formed on a silicon substrate 100, in which the drains are connected to each other by sharing a diffusion layer to be the drains. Moreover, a NMOS transistor 413 of the inverter 322 and the NMOS transistor 301 of the switch 312 are formed on a P-well 102 formed on the silicon substrate 100, in which the drains are connected to each other by sharing a diffusion layer to be the drains. It is noted that the NMOS transistor configuring the inverter 321 and the P-MOS transistor configuring the inverter 322 are not illustrated in FIG. 4.

Furthermore, above the transistors 412, 302, 301, and 413, a first metal 106, a second metal 108, a third metal 110, an electrode 112, a fourth metal 114, and a fifth metal 116 are stacked as an interlayer insulating film 105 is provided between the metals. The fifth metal 116 configures the reflecting electrode 401A formed for the individual pixels. The diffusion layers configuring the sources of the NMOS transistor 301 and the P-MOS transistor 302 configuring the switch 312 are electrically connected to the first metal 106 through a contact 118, and electrically connected to the second metal 108, the third metal 110, the fourth metal 114, and the fifth metal 116 via through holes 119*a*, 119*b*, 119*c*, and 119*e*. Namely, the sources of the NMOS transistor 301 and the P-MOS transistor 302 configuring the switch 312 are electrically connected to a reflecting electrode PE.

Moreover, a passivation film (PSV) 117 is formed as a protective film on the reflecting electrode 401A (the fifth metal 116), and provided apart from and opposite to the common electrode 403, which is a transparent electrode. The liquid crystals 402A are filled and sealed between the reflecting electrode 401A and the common electrode 403, and thus the liquid crystal display element 400A is configured.

Here, the electrode 112 is formed on the third metal 110 through the interlayer insulating film 105. This electrode 112 configures the capacitance $C_1$ together with the interlayer insulating film 105 between the third metal 110 and the third metal 110. When the capacitance $C_1$ is configured using MIM, the SM 121, the switch 311, and the switch 312 can be formed of the transistors and the first layer and second layer interconnections of the first metal 106 and the second metal 108, and the DM 122 can be formed of MIM interconnections using the third metal 110 above the transistor. The electrode 112 is electrically connected to the fourth metal 114 via a through hole 119*d*, and the fourth metal 114 is electrically connected to the reflecting electrode 401A via the through hole 119*e*, and thus the capacitance $C_1$ is electrically connected to the reflecting electrode 401A.

Light from a light source, not illustrated, is transmitted through the common electrode 403 and the liquid crystals 402A, incident to the reflecting electrode 401A (the fifth metal 116) and reflected, returned through the original incident path, and emitted through the common electrode 403.

According to the first embodiment, as illustrated in FIG. 4, the fifth metal 116 in the fifth layer interconnection is allocated to the reflecting electrode 401A, so that the SM 121, the DM 122, and the reflecting electrode 401A can be effectively arranged in the height direction, and the pixel can be downsized. Thus, a pixel having a pitch of three micrometers or less, for example, can be configured of a transistor having a power supply voltage of 3.3 V. A liquid crystal display panel having 4,000 pixels crosswise and 2,000 pixels lengthwise in a diagonal length of 0.55 inches can be implemented using this pixel having a three-micrometer pitch.

Next, data write and read operations in the liquid crystal display device 10 in FIG. 1 using the pixel 12A and the pixel 12B according to the first embodiment will be described with reference to a timing chart in FIG. 5. It is noted that in the data write and read operations, since the switch 350 in FIG. 2 is turned off, the pixel 12A and the pixel 12B are separately and independently operated. Moreover, since the switches 13A and 13B are turned off by the control signal from the timing generator 14 in the data write and read operations, the intermediate voltage is not supplied to the pixels 12A and 12B.

As described above, in the liquid crystal display device 10 in FIG. 1, since the row scanning line is in turn selected one by one per horizontal scanning period from the row scanning line $g_1$ to the row scanning line $g_m$ by the row scanning signal from the vertical shift register 15, data is written to a plurality of the pixels 12A and 12B configuring the image display unit 11 per row of n pixels connected in common to the selected row scanning line. After all of a plurality of the pixels 12A and 12B configuring the image display unit 11 are written, all the pixels are then simultaneously read based on the trigger pulse.

Figure 5:
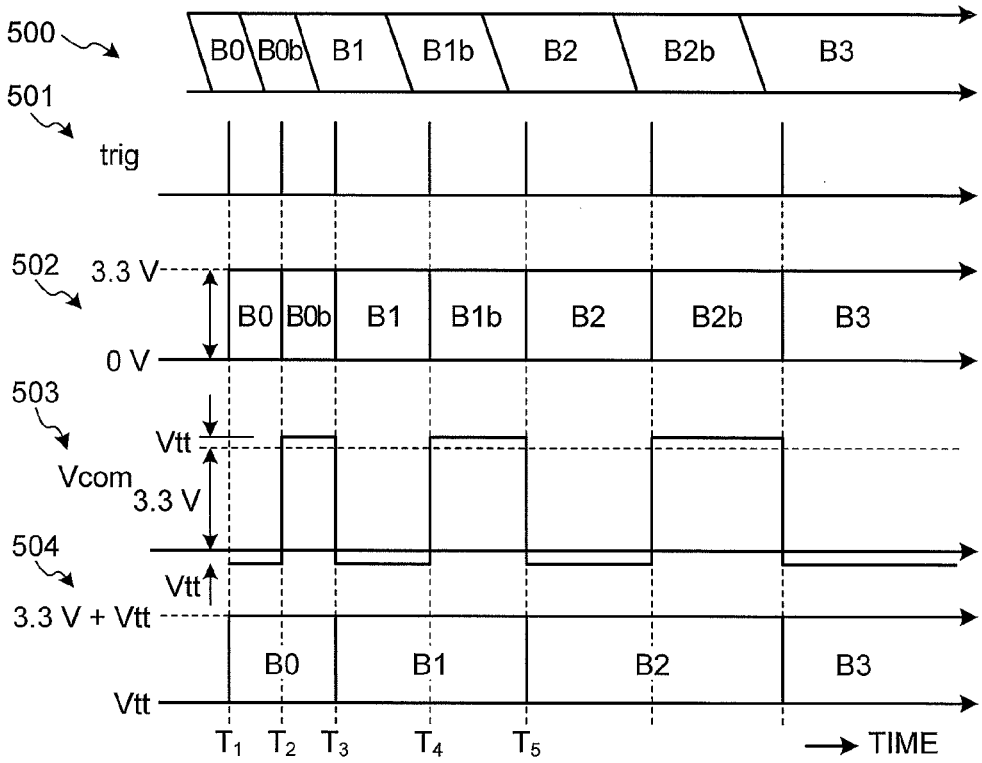
FIG. 5 is a timing chart for describing the write and read operations of a pixel in the liquid crystal display device according to the first embodiment.

In FIG. 5, a chart 500 schematically illustrates the write period and the read period of one pixel for one bit of subframe data outputted from the horizontal driver 17 to the column data lines $d_1$ to $d_n$. Slashes from right to left depict the write periods. It is noted that in the chart 500, "B0*b*", "B1*b*", and "B2*b*" express reverse data of data of bits "B0", "B1", and "B2". Moreover, a chart 501 is a trigger pulse outputted from the timing generator 14 to the forward trigger pulse trigger line trig. This trigger pulse is outputted for every one subframe. It is noted that the reverse trigger pulse outputted to the reverse trigger pulse trigger line trigb always takes a reverse logical value to the forward trigger pulse, and is omitted in the drawing.

First, in a row of a plurality of the pixels 12A and 12B selected by the row scanning signal, in the pixel 12A, the switch 311 is turned on, and the bit "B0" of forward subframe data in FIG. 5 outputted to the column data line $d_1$ when the switch 311 is turned on is sampled by the switch 311 and written to the SM 121. Moreover, in the pixel 12B, the switch 331 is turned on, and the bit "B0" of forward subframe data in FIG. 5 outputted to the column data line $d_2$ when the switch 331 is turned on is sampled by the switch 331 and written to the SM 123. In the following operation, similarly, the bit "B0" of subframe data is written to the SMs 121 and the SMs 123 of all the pixels configuring the image display unit 11, and the forward trigger pulse at "H" level is simultaneously supplied to all the pixels 12A and 12B configuring the image display unit 11 at time $T_1$ illustrated in FIG. 5 after the write operation is finished as illustrated in the chart 501.

Thus, since the switches 312 and 332 of all the pixels 12A and 12B are turned on, the bit "B0" of forward subframe data stored on the SM 121 and the SM 123 is simultaneously transferred and held on the capacitances $C_1$ and $C_2$ through the switch 312, and applied to the reflecting electrodes 401A and 401B. The holding period of the bit "B0" of forward subframe data by these capacitances $C_1$ and $C_2$ is one subframe period from time $T_1$ to time $T_2$ at which the subsequent forward trigger pulse at "H" level is inputted as illustrated in the chart 500. A chart 502 in FIG. 5 schematically illustrates bits of subframe data applied to the reflecting electrodes 401A and 401B.

Here, when the bit value of subframe data is "1", that is, at "H" level, the power supply voltage VDD (a voltage of 3.3 V here) is applied to the reflecting electrodes 401A and 401B, whereas when the bit value is "0", that is, at "L" level, a voltage of zero volt is applied to the reflecting electrodes 401A and 401B. On the other hand, given voltages can be applied as the common electrode voltage Vcom to the common electrode 403, not limited to the GND and the VDD, and the voltage is switched to a prescribed voltage at the same timing at which the forward trigger pulse at "H" level is inputted. Here, in the subframe period in which the forward subframe data is applied to the reflecting electrodes 401A and 401B, the common electrode voltage Vcom is set to a voltage lower than a voltage of zero volt by a threshold voltage Vtt of the liquid crystals as illustrated in a chart 503 in FIG. 5.

The liquid crystal display elements 400A and 400B perform gray scale display according to the applied voltage of the liquid crystals 402A and 402B, which is the absolute value of a differential voltage between the applied voltage of the reflecting electrodes 401A and 401B and the common electrode voltage Vcom. Therefore, in one subframe period from time $T_1$ to time $T_2$ in which the bit "B0" of forward subframe data is applied to the reflecting electrodes 401A and 401B, the applied voltage of the liquid crystals 402A and 402B is a voltage of 3.3 V+Vtt (=3.3 V−(−Vtt)) when the bit value of subframe data is "1", and is a voltage of +Vtt (=0 V−(−Vtt)) when the bit value of subframe data is "0" as illustrated in a chart 504 in FIG. 5.

Figure 6:
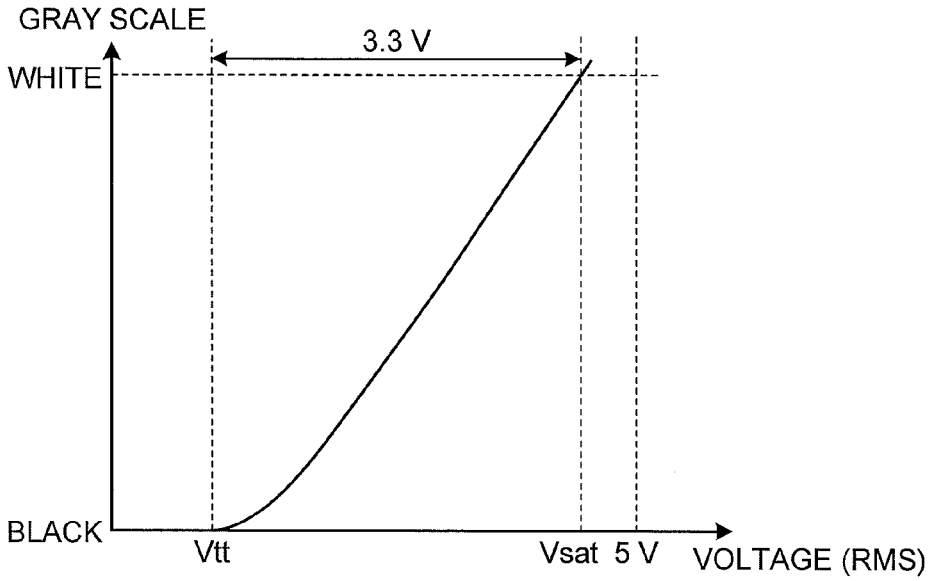
FIG. 6 is an illustration that the saturation voltage and threshold voltage of liquid crystals are multiplexed as binary weighted pulse duration modulated data in the liquid crystal display device according to the first embodiment.

FIG. 6 is the relation between the applied voltage (RMS (Root Mean Square) voltage) of the liquid crystals and the gray scale value of the liquid crystals. As illustrated in FIG. 6, the gray scale value curve is shifted in such a way that a black gray scale value corresponds to the RMS voltage of the threshold voltage Vtt of the liquid crystals and a white gray scale value corresponds to the RMS voltage of a saturation voltage Vsat (=3.3 V+Vtt) of the liquid crystals. The gray scale value can be matched with the effective portion of a liquid crystal response curve. Therefore, the liquid crystal display element (the liquid crystal display element 400A, for example) displays white when the applied voltage of the liquid crystals (the liquid crystals 402A, for example) is a voltage of (3.3 V+Vtt), and displays black when the applied voltage is a voltage of +Vtt as described above.

Subsequently, in the subframe period in which the bit "B0" of forward subframe data is displayed, as illustrated in "B0*b*" in FIG. 5, the write of the reverse subframe data for the bit "B0" to the SM 121 and the SM 123 of the pixels 12A and 12B is in turn started. The reverse subframe data for the bit "B0" is then written to the SM 121 and the SM 123 of all the pixels of the image display unit 11, and the forward trigger pulse at "H" level is simultaneously supplied to all the pixels configuring the image display unit 11 at time T2 after the write is finished as illustrated in FIG. 5.

Thus, since the switches 312 and 332 of all the pixels 12A and 12B are turned on, the reverse subframe data for the bit "B0" stored on the SM 121 and the SM 123 is transferred and held on the capacitances $C_1$ and $C_2$ through the switches 312 and 332, and applied to the reflecting electrodes 401A and 401B. The holding period of the reverse subframe data for the bit "B0" by these capacitances $C_1$ and $C_2$ is one subframe period from time $T_2$ to time $T_3$ at which the subsequent forward trigger pulse at "H" level is inputted as illustrated in FIG. 5. Here, since the reverse subframe data for the bit "B0" is always in the relation of the reverse logical value with the bit "B0" of forward subframe data, the value is "0" when the bit "B0" of forward subframe data is "1", whereas the value is "1" when the bit "B0" of forward subframe data is "0".

On the other hand, in the subframe period in which the reverse subframe data is applied to the reflecting electrodes 401A and 401B, the common electrode voltage Vcom is set to a voltage higher than a voltage of 3.3 V by the threshold voltage Vtt of the liquid crystals as illustrated in the chart 503 in FIG. 5. Therefore, in one subframe period from time $T_2$ to time $T_3$ in which the reverse subframe data for the bit "B0" is applied to the reflecting electrodes 401A and 401B, the applied voltage of the liquid crystals 402A and 402B is a voltage of −Vtt (=3.3 V−(3.3 V+Vtt)) when the bit value of subframe data is "1", and is a voltage of −3.3 V−Vtt (=0 V−(3.3 V+Vtt)) when the bit value of subframe data is "0".

Therefore, when the bit value of the bit "B0" of forward subframe data is "1", the bit value of the reverse subframe data for the bit "B0" subsequently inputted is "0". Thus, the applied voltage of the liquid crystals 402A and 402B is a voltage of −(3.3 V+Vtt), the direction of the potential applied to the liquid crystals 402A and 402B is inverse in the direction of the bit "B0" of forward subframe data but the absolute values are the same, and the pixels 12A and 12B similarly display white as in the display of the bit "B0" of forward subframe data. Similarly, when the bit value of the bit "B0" of forward subframe data is "0", the bit value of the reverse subframe data for the bit "B0" subsequently inputted is "1". Thus, the applied voltage of the liquid crystals 402A and 402B is a voltage of −Vtt, the direction of the potential applied to the liquid crystals 402A and 402B is inverse in the direction of the bit "B0" of forward subframe data but the absolute values are the same, and the pixels 12A and 12B display black.

Therefore, as illustrated in the chart 504 in FIG. 5, in two subframe periods from time $T_1$ to time $T_3$, the pixels 12A and 12B display the same gray scale with the bit "B0" and the complementary bit "B0*b*" to the bit "B0", and alternating drive is performed in which the direction of the potential of the liquid crystals 402A and 402B is inverted for every subframe, so that the burn-in of the liquid crystals 402A and 402B can be prevented.

Subsequently, in the subframe period in which the complementary bit "B0*b*" of reverse subframe data is displayed, as illustrated in "B1" in the chart 500 in FIG. 5, the write of the bit "B1" of forward subframe data to the SM 121 and the SM 123 of the pixels 12A and 12B is in turn started. The bit "B1" of forward subframe data is then written to the SM 121 and the SM 123 of all the pixels 12A and 12B of the image display unit 11, and the forward trigger pulse at "H" level is simultaneously supplied to all the pixels configuring the image display unit 11 at time $T_3$ after the write is finished as illustrated in the chart 501 in FIG. 5.

Thus, since the switches 312 and 332 of all the pixels are turned on, the bit "B1" of forward subframe data stored on the SM 121 and the SM 123 is transferred and held on the capacitances $C_1$ and $C_2$ through the switches 312 and 332, and applied to the reflecting electrodes 401A and 401B. The holding period of the bit "B1" of forward subframe data by these capacitances $C_1$ and $C_2$ is one subframe period from time $T_3$ to time $T_4$ at which the subsequent forward trigger pulse at "H" level is inputted as illustrated in the chart 501 in FIG. 5.

On the other hand, in the subframe period in which the forward subframe data is applied to the reflecting electrodes 401A and 401B, the common electrode voltage Vcom is set to a voltage lower than a voltage of zero volt by the threshold voltage Vtt of the liquid crystals as illustrated in the chart 503 in FIG. 5. Therefore, in one subframe period from time $T_3$ to time $T_4$ in which the bit "B1" of forward subframe data is applied to the reflecting electrodes 401A and 401B, the applied voltage of the liquid crystals 402A and 402B is a voltage of 3.3 V+Vtt (=3.3 V−(−Vtt)) when the bit value of subframe data is "1", and is a voltage of +Vtt (=0 V−(−Vtt)) when the bit value of subframe data is "0" as illustrated in the chart 504 in FIG. 5.

Subsequently, in the subframe period in which the bit "B1" of forward subframe data is displayed, as illustrated in "B1*b*" in the chart 500 in FIG. 5, the write of the reverse subframe data for the bit "B1" to the SM 121 and the SM 123 of the pixels 12A and 12B is in turn started. The reverse subframe data for bit "B1" is then written to the SM 121 and the SM 123 of all the pixels of the image display unit 11, and the forward trigger pulse at "H" level is simultaneously supplied to all the pixels configuring the image display unit 11 at time $T_4$ after the write is finished as illustrated in the chart 501.

Thus, since the switches 312 and 332 of all the pixels 12A and 12B are turned on, the reverse subframe data for the bit "B1" stored on the SM 121 and the SM 123 is transferred and held on the capacitances $C_1$ and $C_2$ through the switches 312 and 332, and applied to the reflecting electrodes 401A and 401B. The holding period of the reverse subframe data for the bit "B0" by these capacitances $C_1$ and $C_2$ is one subframe period from time $T_4$ to time $T_5$ at which the subsequent forward trigger pulse at "H" level is inputted as illustrated in the chart 501 in FIG. 5. Here, the reverse subframe data for the bit "B1" is always in the relation of the reverse logical value with the bit "B1" of forward subframe data.

On the other hand, in the subframe period in which the reverse subframe data is applied to the reflecting electrodes 401A and 401B, the common electrode voltage Vcom is set to a voltage higher than a voltage of 3.3 V by the threshold voltage Vtt of the liquid crystals as illustrated in the chart 503 in FIG. 5. Therefore, in one subframe period from time $T_4$ to time $T_5$ in which the reverse subframe data for the bit "B1" is applied to the reflecting electrodes 401A and 401B, the applied voltage of the liquid crystals 402A and 402B is a voltage of −Vtt (=3.3 V−(3.3 V+Vtt)) when the bit value of subframe data is "1", and is a voltage of −3.3 V−Vtt (=0 V−(3.3 V+Vtt)) when the bit value of subframe data is "0".

Thus, as illustrated in the chart 504 in FIG. 5, in two subframe periods from time $T_3$ to time $T_5$, the pixels 12A and 12B display the same gray scale with the bit "B1" and the complementary bit "B1*b*" to the bit "B1", and alternating drive is performed in which the direction of the potential of the liquid crystals 402A and 402B is inverted for every subframe, so that the burn-in of the liquid crystals 402A and 402B can be prevented. In the following operation, the operations similar to the description above are repeated. In accordance with the liquid crystal display device including the pixels 12A and 12B according to the first embodiment, gray scale display can be performed with the combination of a plurality of subframes.

It is noted that the display periods of the bit "B0" and the complementary bit "B0*b*" are the same first subframe period, and the display periods of the bit "B1" and the complementary bit "B1*b*" are the same second subframe period as well. On the other hand, the first subframe period and the second subframe period are not always the same. Here, for an example, the second subframe period is set twice the first subframe period. Moreover, as illustrated in the chart 504 in FIG. 5, the third subframe period, which is the display periods of the bit "B2" and the complementary bit "B2*b*", is set twice the second subframe period. The same thing is applied to the other subframe periods, and the lengths of the subframe periods are determined to predetermined lengths according to a system, and the number of the subframes is freely determined.

Next, a pixel inspection operation, which is the essential part of the present invention, will be described.

The pixel is inspected for determining the quality of the liquid crystal display device after a wafer is prepared. In the inspection of the pixel, the inspection control signal at high level is outputted from the timing generator 14 to the interconnection pir, the reverse inspection control signal at low level is outputted to the interconnection pirb, and the transmission gate configuring the switch 350 is turned on. Thus, the reflecting electrodes 401A and 401B of these two adjacent pixels 12A and 12B are electrically connected to each other through the switch 350.

One bit of the inspection signal is then written from the column data line $d_1$ to the pixel 12A through the input switch 19$A_1$, the inspection signal written to the pixel 12A is read to the column data line $d_2$ through the pixel 12B, the signals supplied to the column data lines $d_1$ and $d_2$ through the output switches 19$A_2$ and 19$B_2$ are compared with each other, and the quality of the pixels 12A and 12B is determined. Moreover, on the contrary to this, one bit of the inspection signal is written to the pixel 12B from the column data line $d_2$ through the input switch 19$B_1$, the inspection signal written to the pixel 12B is read to the column data line $d_1$ through the pixel 12A, the signals supplied to the column data lines $d_1$ and $d_2$ through the output switches 19$A_2$ and 19$B_2$ are compared with each other, and the quality of the pixels 12A and 12B is determined. However, as described later, before the inspection signal is written from the column data line $d_1$ to the pixel 12A, the intermediate voltage is written to the pixel 12A through the switch 13A. Furthermore, before the inspection signal is written to the pixel 12B from the column data line $d_2$, the intermediate voltage is written to the pixel 12B through the switch 13B.

Next, the basic operations of inspecting the pixel according to the first embodiment will be in turn described.

First, the operation will be described when the switches 13A and 13B are turned off in starting the inspection of the pixel. The row scanning signal at high level is supplied to the row scanning line g in this state, and the switches 311 and 331 are turned on. Moreover, the trigger pulse at high level and the reverse trigger pulse at low level are supplied to the interconnections trig and trigb, respectively, and the switches 312 and 332 are also turned on. Furthermore, the inspection control signal at high level and the reverse inspection control signal at low level are supplied to the interconnections pir and pirb, and the switch 350 is also turned on. Thus, the pixel 12A and the pixel 12B connected from the column data line $d_1$ to the column data line $d_2$ are electrically connected to each other through the switch 350.

Subsequently, data at low level as one bit of the inspection signal is supplied to the column data line $d_1$. Thus, data at low level is written to Point a, which is the connecting point between the input terminal of the inverter 321 and the output terminal of the inverter 322 configuring the SM 121 of the pixel 12A, and data at high level is written to Point b, which is the connecting point at which the output terminal of the inverter 321 and the input terminal of the inverter 322 are connected to the capacitance $C_1$ through the switch 312. At this time, since the driving force of the transistor configuring the inverter 321 is greater than the driving force of the transistor configuring the inverter 322 in the SM 121 of the pixel 12A, Point a functions as the input of the SM 121, and Point b functions as the output of the SM 121.

Moreover, data at high level at Point b is data at Point d, which is the connecting point between the switch 332 and the capacitance $C_2$ in the pixel 12B connected through the switch 350 in the ON-state. Here, the driving force of the transistor configuring the inverter 341 is greater than the driving force of the transistor configuring the inverter 342 in the SM 123 in the pixel 12B. Thus, Point c, which is the connecting point between the input terminal of the inverter 341 and the output terminal of the inverter 342, functions as the input of the SM 123, and Point d, which is the connecting point at which the output terminal of the inverter 341 and the input terminal of the inverter 342 are connected to the capacitance $C_2$ through the switch 332, functions as the output of the SM 123. Therefore, since Point b and Point d correspond to the output terminals of the SM 121 and the SM 123, respectively, the SM 123 is generally hardly inverted even though data outputted from the SM 121 is inputted to the output terminal of the SM 123.

This will be described in detail with reference to FIG. 7. The output capability of the SM 121 is determined by the driving forces of the P-MOS transistor 412 and a NMOS transistor 414 configuring the inverter 321. On the other hand, the output capability of the SM 123 is determined by the driving forces of the P-MOS transistor 415 and a NMOS transistor 416 configuring the inverter 341. Since the transistors configuring the pixels 12A and 12B provide the same capabilities to each of the pixels 12A and 12B, the driving forces of the P-MOS transistor 412 and the NMOS transistor 414 configuring the inverter 321 and the driving forces of the P-MOS transistor 415 and the NMOS transistor 416 configuring the inverter 341 are the same between the P-MOS transistors 412 and 415 and between the NMOS transistors 414 and 416.

In the case where data at low level at Point d is rewritten at high level by driving the inverter 341, the voltage at Point b, which is the connecting point between the inverter 321 and the switch 350 configured of a P-MOS transistor 420 and a NMOS transistor 421, and the voltage at Point d, which is the connecting point between the inverter 341 and the switch 350, are determined by the ratio between an electric current carried through the NMOS transistor 416 configuring the inverter 341 and an electric current carried through the P-MOS transistor 412 configuring the inverter 321.

Figure 7:
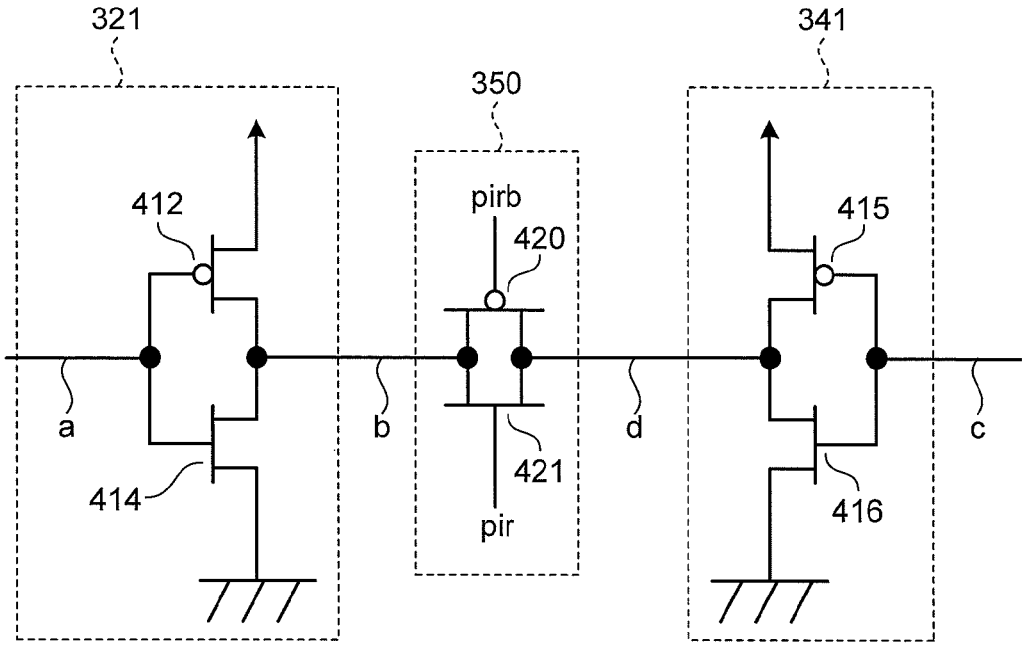
FIG. 7 is a circuit diagram illustrative of the sizes of the driving force between inverters in the two pixels in FIG. 2 according to the first embodiment.

Here, in FIG. 7, in the case where the output data of the inverter 321 at Point b is at high level, the P-MOS transistor 412 configuring the inverter 321 is in the ON-state. On the other hand, in the case where the output data of the inverter 341 at Point d is already at low level, the NMOS transistor 416 configuring the inverter 341 is in the ON-state.

At this time, in the case where the switch 350 is turned on and the outputs of the inverter 341 and the inverter 321 are conduced to each other by the inspection control signal at high level on the interconnection pir and the reverse inspection control signal at low level on the interconnection pirb, an electric current is carried from the VDD to the GND through the P-MOS transistor 412 of the inverter 321 and the NMOS transistor 416 of the inverter 341. At this time, the voltages at Point b and Point d are determined by the ratio of the ON-resistance between the P-MOS transistor 412 and the NMOS transistor 416.

Moreover, the input gate, not illustrated, of the inverter 342 is connected to Point d, and output data is fixed at low level or high level in the inverter 342 depending on the input of the voltage level at Point d. In other words, data at Point c read out of the SM 123 is determined depending on the voltage level at Point d.

However, generally, when the gate width of the transistor is the same, the driving force of the NMOS transistor is about three times greater than the driving force of the P-MOS transistor. Thus, also on the ON-resistance of the transistors, the NMOS transistor is lower than the P-MOS transistor. In the case of the description above, the voltages at Point b and Point d are lower than the intermediate voltage of the power supply voltage, and data corresponds to data at low level as data inputted to the inverter 342. Therefore, such an event is taken place in which data at the output (Point c) of the inverter 342 remains at high level, and the SM 123 is not enabled to output data at low level due to data at low level inputted from the column data line $d_1$ to the SM 121.

It is possible to rewrite data at Point c of the SM 123 with data at low level using data at high level inversely applied to Point a of the SM 121 from the ratio between the driving forces of the P-MOS transistor and the NMOS transistor configuring the inverter described above.

In the first embodiment, in order to cope with the operation failures above, the switch 13B is turned to the ON-state to conduct the intermediate voltage generating unit 18 to the column data line $d_2$ in starting the inspection of the pixel, and the voltage of the column data line $d_2$ is precharged to the intermediate voltage outputted from the intermediate voltage generating unit 18 to the interconnection mid. It is noted that the intermediate voltage described above means the voltage of the center voltage in the power supply voltage range (therefore, in the case where the power supply voltage range is a voltage of 3.3 V, it is a voltage of 1.65 V) or less, desirably, the set voltage in the voltage range of zero volt to the center voltage (therefore, in the case where the power supply voltage range is from a voltages of 0 V to 3.3 V, it is a voltage range of 0 V to about 1.65 V).

Figure 8A:
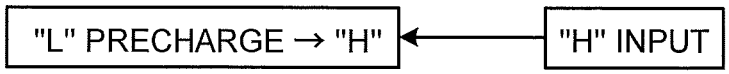
FIG. 8A is a diagram illustrative of the operations of the essential part in the two pixels in FIG. 2 according to the first embodiment.

FIGS. 8A to 8D are the relation between data write and data read of the pixels 12A and 12B adjacent in the column direction in the case where the intermediate voltage is at zero volt. It is noted that in FIGS. 8A to 8D, the left side in the drawings expresses data at Point c of the pixel 12B, and the right side in the drawings expresses data at Point a of the pixel 12A. FIG. 8A illustrates that in the case where Point c of the pixel 12B is precharged at low level (at zero volt here), when data at high level is written to the column data line $d_1$ to turn data at Point a of the pixel 12A at high level, data at Point c of the pixel 12B is rewritten at high level.

Namely, in this case, the switch 13B is turned on when the switches 311, 312, 331, 332 and 350 are in the ON-state, the potentials of the column data line $d_2$ and Point c of the pixel 12B are precharged to a voltage of zero volt (at low level), and the voltage at Point d of the pixel 12B is preset to a voltage of 3.3 V at high level. In this state, in the case where data at high level is written to the column data line $d_1$ to turn data at Point a of the pixel 12A at high level, the voltage at Point b of the pixel 12A is going to low level. At this time, since Point b is connected to Point d through the switch 350, the voltages at Point b and Point d are determined by the ratio between the electric current carried through the NMOS transistor 414 configuring the inverter 321 and the electric current carried through the P-MOS transistor 415 configuring the inverter 341.

In other words, in a period during which the switch 13B is on, the electric current is to flow from the VDD to the GND. At this time, since the driving force of the NMOS transistor is greater than the driving force of the P-MOS transistor, the voltages at Point b and Point d are at the intermediate potential close to the GND in the voltage range of the VDD to the GND. Since the intermediate potential is on the potential side lower than the inverted threshold voltage of the inverter, the voltages at Point b and Point d are in the state in which the voltages are easily inverted to the low level side. Here, when the switch 13B is turned off, the voltage at Point d is simultaneously set at low level, the potentials of the column data line $d_2$ and Point c of the pixel 12B are turned at high level. FIG. 8A illustrates the operations above.

Figure 8B:
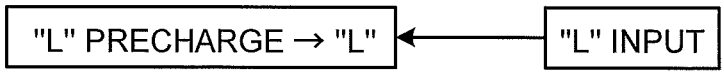
FIG. 8B is a diagram illustrative of the operations of the essential part in the two pixels in FIG. 2 according to the first embodiment.

FIG. 8B illustrates that in the case where Point c of the pixel 12B is precharged at low level (at zero volt here), when data at low level is written to the column data line $d_1$ and data at Point a of the pixel 12A is turned at low level, data at Point c of the pixel 12B is rewritten at low level.

Namely, in this case, the switch 13B is turned on when the switches 311, 312, 331, 332 and 350 are in the ON-state, the potentials of the column data line $d_2$ and Point c of the pixel 12B are precharged to a voltage of zero volt (at low level), and the voltage at Point d of the SM 123 is preset to a voltage of 3.3 V at high level. In this state, in the case where data at low level is written to the column data line $d_1$ and data at Point a of the pixel 12A is turned at low level, the voltage at high level is inputted to Point b of the pixel 12A. At this time, the voltage at Point d of the pixel 12B is already preset at high level, even though the switch 13B is turned off after that, and the potentials of the column data line $d_2$ and Point c of the pixel 12B remain at low level. FIG. 8B illustrates the operations above.

Figure 8C:
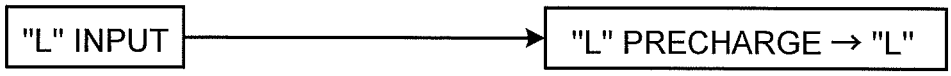
FIG. 8C is a diagram illustrative of the operations of the essential part in the two pixels in FIG. 2 according to the first embodiment.
Figure 8D:
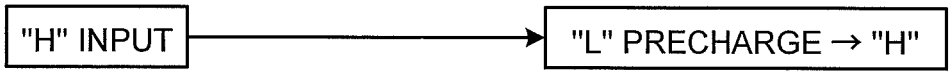
FIG. 8D is a diagram illustrative of the operations of the essential part in the two pixels in FIG. 2 according to the first embodiment.

FIGS. 8C and 8D illustrate the operations in the case where Point a of the pixel 12A is precharged. The operations in this case are similar to the operations in the case where Point c of the pixel 12B is precharged described with reference to FIGS. 8A and 8B except that the switch 13A is turned on, not the switch 13B, and the description is omitted.

The pixel inspection described above is performed on two laterally adjacent pixels 12A and 12B twice at different timings according to two types of methods, a first inspection method in which data is inputted from the column data line $d_1$ and data is read out of the column data line $d_2$, and a second inspection method in which data is inputted from the column data line $d_2$ and data is read out of the column data line $d_1$.

Thus, it is possible to read the voltage at low level and the voltage at high level in the pixels 12A and 12B, so that it is possible to inspect logical pixel functions as a memory. At this time, for example, when the capacitance $C_1$ or the capacitance $C_2$ has a short circuit on a GND or VDD interconnection, for example, due to processes, it is not enabled to read a given data in the inspection of the pixel. Moreover, also in the case where the SM 121 or the SM 123 has a short circuit or a broken line, it is not enabled to read a given data in the inspection of the pixel. In the case where data read is not enabled as described above, measures are taken such as stopping the shipment of a liquid crystal display device including defective pixels.

Figure 9:
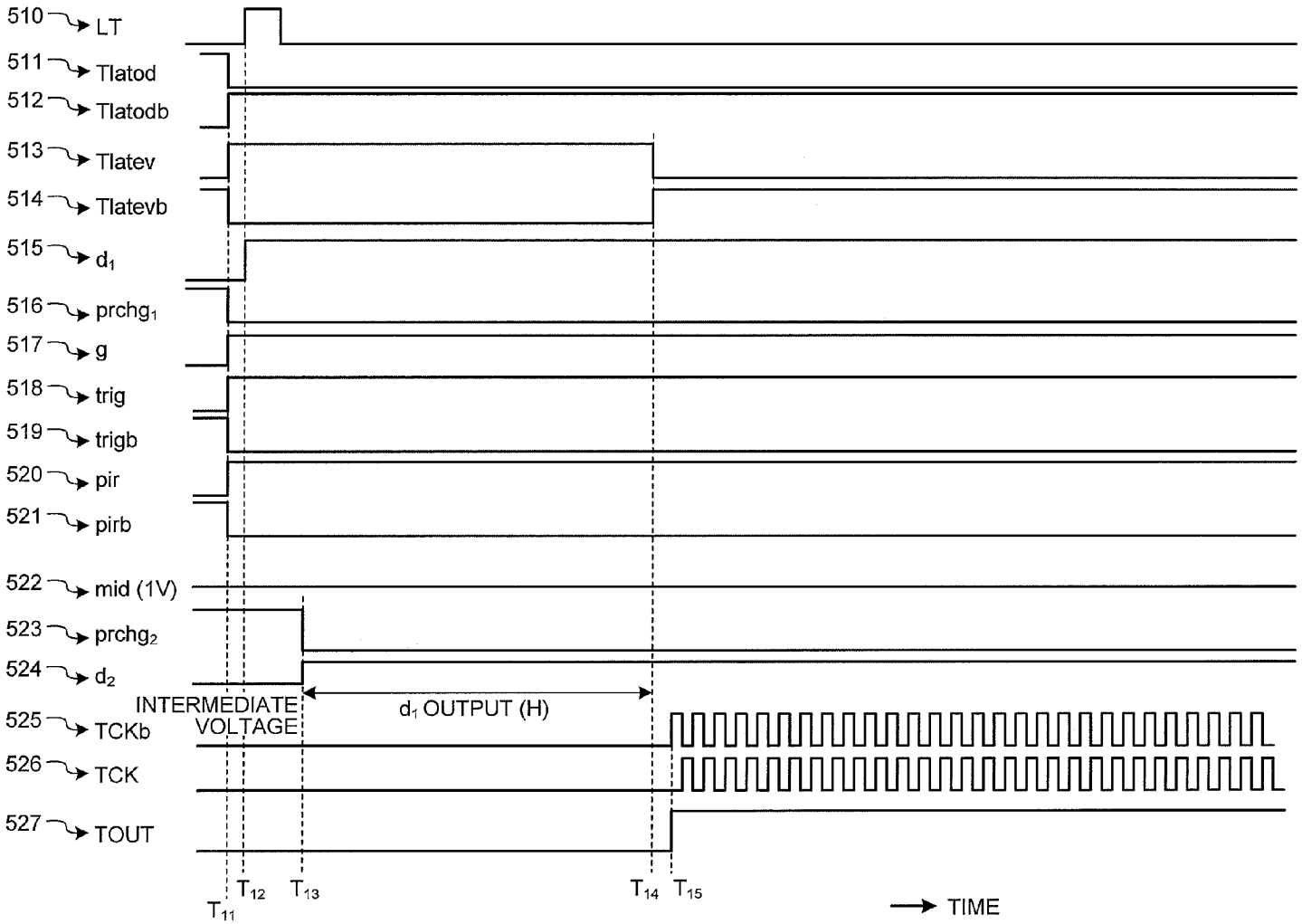
FIG. 9 is a timing chart for describing the operations in the inspection of the pixels in FIG. 1 and FIG. 2 according to the first embodiment.

Next, the operations of inspecting pixels according to the first embodiment to cope with the operation failures described above will be further described in detail with reference to the overall structure in FIG. 1, the circuit diagram in FIG. 2, and a timing chart in FIG. 9.

In the inspection of the pixels, first, as described with reference to FIG. 8A, suppose that the pixel 12B connected to the even-numbered column data line $d_{ev}$ ($d_2$, $d_4$, $d_6$, to $d_n$) is on the inspection signal read side, and the pixel 12A connected to the odd-numbered column data line $d_{od}$ ($d_1$, $d_3$, $d_5$, to $d_{n-1}$) is on the inspection signal write side. In this case, at time $T_{11}$ that is the beginning in the inspection of the pixels, the switch control signal Tlatodb is turned at high level as illustrated in a chart 512 in FIG. 9, the input switch 19$A_1$ is turned on, and the switch control signal Tlatevb is turned at low level as illustrated in a chart 514, and the input switch 19$B_1$ is controlled to be turned off. Moreover, at time $T_{11}$, the switch control signal Tlatod is turned at low level as illustrated in a chart 511, and the output switch 19$A_2$ is turned off, and the switch control signal Tlatev is turned at high level as illustrated in a chart 513, and the output switch 19$B_2$ is turned on. Thus, the odd-numbered column data line $d_{od}$ ($d_1$, $d_3$, $d_5$, to $d_{n-1}$) functions as an inspection signal input interconnection, and the state is turned into the state in which the inspection signal can be written to all the pixels 12A configuring the image display unit 11, as well as the even-numbered column data line $d_{ev}$ ($d_2$, $d_4$, $d_6$, to $d_n$) functions as an inspection signal read interconnection, and the state is turned into the state in which the inspection signal can be read out of all the pixels 12B configuring the image display unit 11.

Furthermore, at time $T_{11}$ described above, the first control signal applied through a control signal line $prchg_1$ is turned at low level as illustrated in a chart 516, all the switches 13A are turned off, and the inspection signal from the horizontal driver 17 is allowed to be written to the pixel 12A. In addition, simultaneously to this, at time $T_{11}$ described above, the second control signal applied through a control signal line $prchg_2$ is turned at high level as illustrated in a chart 523, all the switches 13B are turned on, and the intermediate voltage supplied from the intermediate voltage generating unit 18 through the interconnection mid is precharged on the even-numbered column data line $d_{ev}$ ($d_2$, $d_4$, $d_6$, to $d_n$). A chart 524 expresses the voltage of the column data line $d_2$, for example, in which the intermediate voltage is precharged for a period from time $T_{11}$ to time $T_{13}$, described later. A chart 522 expresses the intermediate voltage on the interconnection mid. It is noted that as described above, the intermediate voltage is a voltage within the range of about voltages of 0 to 1.65 V when the power supply voltage is at a voltage of 3.3 V. However, the intermediate voltage is a voltage of one volt as an example here.

The pixel is inspected in a unit of pixels in individual rows configuring the image display unit 11. Now, suppose that as illustrated in a chart 517, the row scanning signal at high level is inputted from the vertical shift register 15 to a certain row scanning line g of the image display unit 11 at time $T_{11}$ to select a row of the pixels 12A and 12B connected to the row scanning line g. At this time, trigger signals at high level and at low level are simultaneously supplied to the interconnections trig and trigb as illustrated in charts 518 and 519, and the switches 312 in the selected row of the pixels 12A and the switches 332 in the pixels 12B are turned on. Moreover, at this time, the inspection control signals at high level and at low level are simultaneously supplied to the interconnections pir and pirb as illustrated in charts 520 and 521, and the switch 350 provided in common between the pixel 12A and the pixel 12B adjacent to each other is turned on in the selected row of the pixels.

Subsequently, at time $T_{12}$ at which a row of the inspection signals is shifted on the horizontal shift register 171 for a predetermined column of the pixels, the latch pulse LT illustrated in a chart 510 is outputted from the timing generator 14, and the inspection signals for a row of n pixels from the horizontal shift register 171 are latched by the latch circuit 172. Here, suppose that the inspection signals for a row of n pixels are all at high level. After time $T_{12}$, the inspection signals at high level are outputted from the latch circuit 172 to the column data lines $d_1$ to $d_n$ through the level shifter/pixel driver 173.

Here, since the input switch 19$A_1$ is turned on at this time, the inspection signals outputted to the column data lines $d_1$ to $d_n$ are written to the pixel 12A through the input switch 19$A_1$ and the column data line $d_{od}$. However, since the output switch 19$A_2$ is off, the inspection signal is not written to the pixel 12B through the column data line $d_{ev}$. A chart 515 expresses the inspection signal outputted to the column data line $d_1$. At this point in time, the inspection signal is at high level at Point a of the pixel 12A illustrated in FIG. 2, and the intermediate voltage is precharged at Point c of the pixel 12B.

Subsequently, at time $T_{13}$, the second control signal applied through the control signal line $prchg_2$ is switched at low level as illustrated in the chart 523, and all the switches 13B are switched off. Thus, when the quality of the pixel 12A and the pixel 12B illustrated in FIG. 2 is good, the voltages at Point b and Point d illustrated in FIG. 2 are at low level as described with reference to FIG. 8A, and the voltage at Point c of the pixel 12B and the potential of the column data line $d_2$ are changed from the intermediate voltage as illustrated in the chart 524 to the inspection signal at high level inputted to the column data line $d_1$. The signal at high level outputted from the pixel 12B to the column data line $d_2$ is inputted to the place corresponding to the relevant column of the pixel read shift register 21 at capacitance corresponding to the number of pixels a half of the number of pixels in one row through the output switch 19$B_2$ and the buffer 20.

Subsequently, at time $T_{14}$, when the switch control signal Tlatev is turned at low level and the output switch 19$B_2$ is turned off as illustrated in the chart 513, a row of the signals read out of the selected row of the pixels 12B to the even-numbered column data line $d_{ev}$ is stored on the pixel read shift register 21.

Subsequently, from time $T_{15}$, a first clock signal TCKb illustrated in a chart 525 and a second clock signal TCK illustrated in a chart 526 in anti-phases to each other, which are supplied to the pixel read shift register 21, are alternately and repeatedly turned on and off. Thus, in the readout signals stored on the pixel read shift register 21, the readout signal is in turn outputted to the output terminal TOUT illustrated in a chart 527 from the readout signal out of the column data line $d_{n-1}$ to the readout signal out of the column data line $d_1$. The clock signals TCKb and TCK are repeatedly turned on and off for a half of the number of pixels in one row to read all the data, and inspection for a row is finished. The readout signals for a row of the pixels are compared with the inputted inspection signals, and the pixels can be inspected according to whether both are the same.

Subsequently, the switch control signals Tlatodb, Tlatevb, Tlatod, and Tlatev are switched to have the logical values opposite to the values at time $T_{11}$, the inspection signal is turned in the state in which the inspection signal can be written to all the pixels 12B configuring the image display unit 11 as well as the inspection signal is turned in the state in which the inspection signal can be read out of all the pixels 12A configuring the image display unit 11. In the following operation, similarly to the description above, the inspection signal written from the pixel 12B is read out of the pixel 12A, and is stored on the pixel read shift register 21. At this time, the logical values of the control signals applied through the control signal lines $prch_1$ and $prchg_2$ are also set opposite in the chart 516 and the chart 523. As described above, the inspection of the pixels described with reference to FIG. 8D can be performed on a row of the pixels.

After finishing the operations above, the vertical shift register 15 is then controlled to select the pixels 12A and 12B in the subsequent row of the pixels, and the pixels are inspected similarly to the descriptions above. These operations are repeated to inspect the number of pixels in the vertical direction, and inspection is performed on all the pixels configuring the image display unit 11.

It is noted that the inspection signals to be inputted are not necessarily all at high level as described above. All the inspection signals may be at low level, or it may be possible that the inspection signals are repeatedly switched between high level and low level and the potential difference is provided between the pixels 12A and 12B adjacent in the lateral direction for short circuit inspection.

As described above, according to the first embodiment, it is possible to accurately inspect pixels. According to the embodiment, although two transistors are increased to the number of the transistors configuring the switch 350 shared by the pixel 12A and the pixel 12B for pixel inspection, and two transistors for the switches 13A and 13B are increased to all the pixels configuring the image display unit 11, the increased number is really few. It is possible to downsize a pixel as compared with the previously existing liquid crystal display device using a pixel including two SRAMs, and it is possible to accurately inspect pixels.

Figure 10:
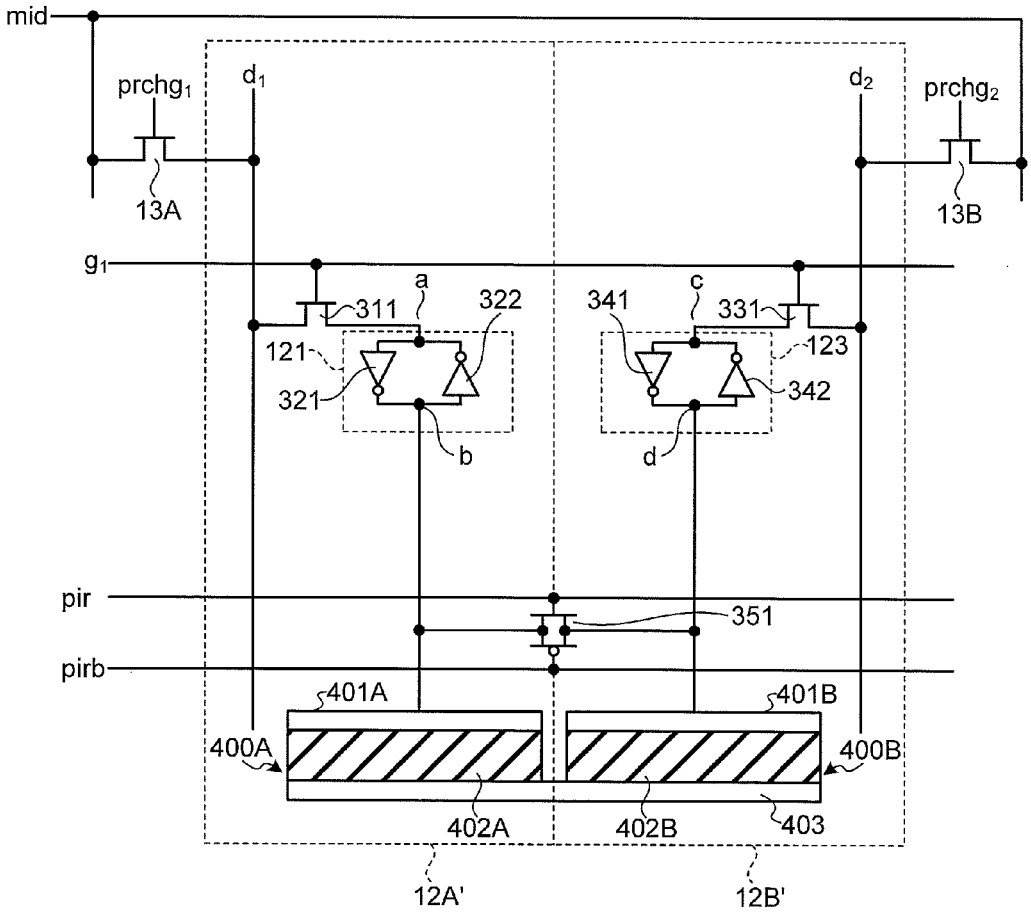
FIG. 10 is a circuit diagram of two adjacent pixels connected to the same row scanning line in a liquid crystal display device according to a second embodiment.

Next, a second embodiment will be described. FIG. 10 is the equivalent circuit of a pixel, which is the essential part of a liquid crystal display device according to the second embodiment, together with surrounding circuits. In FIG. 10, the same reference numerals and signs are designated the same components in FIG. 2, and the description is omitted. In FIG. 10, a pixel 12A' and a pixel 12B' are two adjacent pixels in the column direction connected to a given same one row scanning line g in FIG. 1, in which the pixel 12A' is provided at the intersecting portion of a given column data line $d_1$ and one row scanning line g and the pixel 12B' is provided at the intersecting portion of the column data line $d_2$ adjacent to the column data line $d_1$ and the row scanning line g.

The pixel 12A' and the pixel 12B' are characterized in the configuration in that as compared with the pixel 12A and the pixel 12B illustrated in FIG. 2, the pixel 12A' and the pixel 12B' are not provided with the DRAMs 122 and 124 and the output terminals of SMs 121 and 123 are connected to reflecting electrodes 401A and 401B through a shared switch 351.

Namely, the pixel 12A' includes a static random access memory (SRAM) configured of a switch 311 configuring a first switching unit and a first signal holding unit (SM) 121 and a liquid crystal display element 400A. Moreover, the pixel 12B' includes a static random access memory (SRAM) configured of a switch 331 configuring a first switching unit and a first signal holding unit (SM) 123 and a liquid crystal display element 400B. Furthermore, the pixel 12A' and the pixel 12B' share the switch 351 configuring a third switching unit.

The switch 351 is in the publicly known transmission gate configuration formed of an NMOS transistor and a P-MOS transistor in which the drains of the transistors are connected to each other and the sources are connected to each other. The gate of the NMOS transistor that is the control terminal of the transmission gate configuring the switch 351 is connected to a forward inspection control signal interconnection pir, and the gate of the P-MOS transistor is connected to a reverse inspection control signal interconnection pirb. In addition, in two terminals of the transmission gate configuring the switch 351, the drains (or the sources) of the NMOS transistor and the P-MOS transistor, which are one terminal, are connected to the output terminal of the SM 121 and the reflecting electrode 401A, and the sources of (or the drains) of the NMOS transistor and the P-MOS transistor, which are the other terminal, are connected to the output terminal of the SM 123 and the reflecting electrode 401B.

In the data write and read operations in the liquid crystal display device 10 in FIG. 1 using the pixel 12A' and the pixel 12B' according to the second embodiment, the point is the same in that the switch 351 in FIG. 10 is turned off to separate the pixel 12A' from the pixel 12B' for independent operations as compared with the liquid crystal display device using the pixel 12A and the pixel 12B. On the other hand, in the data write and read operations in the liquid crystal display device 10 in FIG. 1 using the pixel 12A' and the pixel 12B' according to the second embodiment, subframe data is written to and read out of the pixels 12A' and 12B' per row.

Next, the basic operations of inspecting the pixel according to the second embodiment will be in turn described.

First, one of the switches 13A and 13B is turned on, and the other is turned off. Here, the case will be described where the switch 13A is turned off and the switch 13B is turned on. Thus, when the pixel inspection is started, Point c of the pixel 12B' in FIG. 10 is precharged at low level by the intermediate voltage applied through the switch 13B.

The row scanning signal at high level is supplied to the row scanning line g in this state, and the switches 311 in the pixels 12A' and the switches 331 in the pixels 12B' in a row connected to the same row scanning line g are turned on. It is noted that in the following description, the pixels 12A' and 12B' in a row connected to the same row scanning line g perform the same operation for each of two adjacent pixels. However, for convenience of explanation, two adjacent pixels 12A' and 12B' illustrated in FIG. 10 will be described. Moreover, the inspection control signal at high level and the reverse inspection control signal at low level are supplied to the interconnections pir and pirb, and the switch 351 is also turned on. Thus, the pixel 12A' and the pixel 12B' connected from the column data line $d_1$ to the column data line $d_2$ in FIG. 10 are in the state in which the pixel 12A' is electrically connected to the pixel 12B' through the switch 351.

Subsequently, data at high level as one bit of the inspection signal is supplied to the column data line $d_1$. Thus, data at high level is written to Point a, which is the connecting point between the input terminal of the inverter 321 and the output terminal of the inverter 322 configuring the SM 121 of the pixel 12A', and data at low level is written to Point b, which is the connecting point between the output terminal of the inverter 321 and the input terminal of the inverter 322. At this time, since the driving force of the transistor configuring the inverter 321 is greater than the driving force of the transistor configuring the inverter 322 in the SM 121 of the pixel 12A', Point a functions as the input of the SM 121, and Point b functions as the output of the SM 121.

Moreover, data at low level at Point b is turned to data at Point d, which is the connecting point between the output terminal of the inverter 341 and the input terminal of the inverter 342 configuring the SM 123 in the pixel 12B' connected through the switch 351 in the ON-state. Here, since the driving force of the transistor configuring the inverter 341 is greater than the driving force of the transistor configuring the inverter 342 in the SM 123 in the pixel 12B', Point c, which is the connecting point between the input terminal of the inverter 341 and the output terminal of the inverter 342, functions as the input of the SM 123, and Point d functions as the output of the SM 123. Therefore, since Point b and Point d correspond to the outputs of the SM 121 and the SM 123, respectively, the SM 123 is generally hardly inverted even though data outputted from the output of the SM 121 is inputted to the output of the SM 123.

In the second embodiment, similarly to the first embodiment in FIG. 2 as described above, the switch 13B is turned on when the switches 311, 331, and 351 are in the ON-state, the potentials of the column data line $d_2$ and Point c of the pixel 12B' are precharged to a voltage of zero volt (at low level), for example, which is the intermediate voltage, and the voltage at Point d of the SM 123 is preset to a voltage of 3.3 V at high level.

In this state, in the case where the inspection signal at high level is written to the column data line $d_1$ and data at Point a of the pixel 12A' is turned at high level, the voltage at Point b of the pixel 12A' is going to low level. At this time, since Point b is connected to Point d through the switch 351, the voltages at Point b and Point d are determined by the ratio between an electric current carried through the NMOS transistor configuring the inverter 321 and an electric current carried through the P-MOS transistor configuring the inverter 341.

In other words, in a period during which the switch 13B is on, the electric current is to flow from the VDD to the GND. At this time, since the driving force of the NMOS transistor is greater than the driving force of the P-MOS transistor, the voltages at Point b and Point d are at the intermediate potential close to the GND in the voltage range of the VDD to the GND. Since the intermediate potential is on the potential side lower than the inverted threshold voltage of the inverter, the voltages at Point b and Point d are in the state in which the voltages are easily inverted to the low level side.

Here, the switch 13B is switched off. Thus, when the quality of the pixel 12A' and the pixel 12B' in FIG. 10 is good, the voltages at Point b and Point d illustrated in FIG. 10 are turned at low level, and the voltage at Point c of the pixel 12B' and the potential of the column data line $d_2$ are changed from the intermediate voltage to the inspection signal at high level inputted to the column data line $d_1$. The signal at high level outputted from the pixel 12B' to the column data line $d_2$ is inputted to the place corresponding to the relevant column of the pixel read shift register 21 at capacitance corresponding to the number of pixels a half of the number of pixels in one row through the output switch 19$B_2$ and the buffer 20 illustrated in FIG. 1. In the following operation, the pixel inspection operations similar to the first embodiment described with reference to the timing chart illustrated in FIG. 9 are performed (except the interconnection trig in the chart 518 and the interconnection trigb in the chart 519).

The pixel inspection described above is performed on two laterally adjacent pixels 12A' and 12B' twice at different timings according to two types of methods, a first inspection method in which the inspection signal is inputted from the column data line $d_1$ and data is read out of the column data line $d_2$, and a second inspection method in which the inspection signal is inputted from the column data line $d_2$ and data is read out of the column data line $d_1$.

Thus, it is possible to read the voltage at low level and the voltage at high level in the pixels 12A' and 12B', so that it is possible to inspect logical pixel functions as a memory. At this time, also in the case where the SM 121 or the SM 123 has a short circuit or a broken line due to processes, for example, it is not enabled to read a given data in the inspection of the pixel. In the case where data read is not enabled as described above, measures are taken such as stopping the shipment of a liquid crystal display device including defective pixels.

As described above, according to the second embodiment including the pixel 12A' and 12B', it is further possible to downsize pixels as compared with the liquid crystal display device including the pixels 12A and 12B according to the first embodiment, and it is possible to accurately inspect pixels.

It is noted that the present invention is not limited to the embodiments above. For example, in the embodiments in FIGS. 2 and 10, in order to cope with the operation failures of the SM 121 and the SM 123, in the first and second pixels adjacent to each other, which include the switches 13A and 13B and are connected to the same row scanning line, the inspection signal is written to the first pixel through the first column data line, the second pixel connected to the second column data line is precharged at the intermediate voltage, and the input of the intermediate voltage is then released to read the inputted inspection signals out of the second pixel to the second column data line. However, theoretically, pixel inspection is possible even though the switches 13A and 13B are not included with no recharging. Moreover, although the description is made as the pixel electrode is the reflecting electrode, the pixel electrode may be a transmissive electrode.

As described above, the liquid crystal display device according to the present invention and the pixel inspection method therefor are useful for a high definition liquid crystal display device, and more specifically suited to a full high definition liquid crystal display device.

What is claimed is:

1. A liquid crystal display device comprising:

a plurality of pixels configured to be provided at an intersecting portion at which a plurality of column data lines intersects with a plurality of row scanning lines, in which two adjacent pixels that are connected to a same row scanning line are paired, each of the two pixels of each pairs individually including:

a display element configured to be filled and seal with liquid crystal between a pixel electrode and a common electrode opposite to each other;

a first switching unit configured to be connected to the row scanning line and configured to sample each subframe data for displaying each of a plurality of subframes having a display period shorter than one frame period of the video signal through the column data line when selecting a row, the plurality of subframes being for displaying one frame;

a first signal holding unit configured to form a static random access memory together with the first switching unit and configured to store the subframe data sampled by the first switching unit;

the display element, the first switching unit, and the first signal holding unit being provided separately in each of the pixels in the pair; and a second switching unit configured to connect or disconnect a connecting point between the first signal holding unit and the pixel electrode in the two pixels, the second switching unit being provided commonly in each of the pairs;

a switching control unit configured to control the second switching unit to be turned off when writing and reading the pixels and control the second switching unit to be turned on when inspecting the pixels;

a pixel control unit configured to perform, when writing and reading the pixels, for each of the subframe, an operation in which the subframe data is written into the first signal holding unit for each of the pixels per row in the plurality of pixels configuring the image display unit and the written data is applied to the pixel electrode; and an inspection control unit configured to alternately perform a first inspection operation in which an inspection signal is input from a first column data line connected to one pixel of the two pixels in each of the pairs into the one pixel and is read out to a second column data line connected to another pixel through the other pixel of the two pixels in each of the pairs and a second inspection operation in which an inspection signal is input from the second column data line into the other pixel and is read out to the first column data line through the one pixel, on all of the plurality of pixels in a unit of pixels in each row when the pixels being inspected.

2. The liquid crystal display device according to claim 1, wherein:

the two adjacent pixels that connected to the same row scanning line in each of the pairs further individually include:

a third switching unit configured to output the subframe data stored in the first signal holding unit; and a second signal holding unit configured to form a dynamic random access memory together with the third switching unit, in which stored content is rewritten with the subframe data stored on the first signal holding unit, the subframe data being supplied through the third switching unit, and configured to apply output data to the pixel electrode;

the third switching unit and the second signal holding unit are provided separately in each of the pixels in the pair;

the second switching unit is configured to connect or disconnect a connecting point between the second signal holding unit and the pixel electrode in the two pixels;

the pixel control unit performs, when writing and reading the pixels, for each of the subframe, an operation in which the subframe data is repeatedly written into the first signal holding unit for each of the pixels per row in the plurality of pixels configuring the image display unit, after the writing for all of the plurality of pixels, the third switching units in all of the plurality of pixels are turned on with a trigger pulse, and stored content in the second signal holding units in the plurality of pixels is rewritten with the subframe data stored in the first signal holding unit; and the inspection control unit alternately performs a first inspection operation in which the third switching unit is controlled to be turned on, an inspection signal is input from a first column data line connected to one pixel of the two pixels in each of the pairs into the one pixel and is read out to a second column data line connected to another pixel through the other pixel of the two pixels in each of the pairs and a second inspection operation in which an inspection signal is input from the second column data line into the other pixel and is read out to the first column data line through the one pixel, on all of the plurality of pixels in a unit of pixels in each rows when the pixels being inspected.

3. The liquid crystal display device according to claim 1, further comprising:

an intermediate voltage generating unit configured to generate an intermediate voltage that is a set voltage at a center voltage or less in a power supply voltage range;

a fourth switching unit configured to be connected between a first column data line connected to one pixel of the two pixels in each of the pairs and the intermediate voltage generating unit; and a fifth switching unit configured to be connected between a second column data line connected to the other pixel of the two pixels in each of the pairs and the intermediate voltage generating unit, wherein the inspection control unit alternately performs a first inspection operation in which in a state in which the fifth switching unit is turned on and the intermediate voltage is applied and precharged to the other pixel through the second column data line, an inspection signal is input from the first column data line to the one pixel, and then a signal is read out from the other pixel to the second column data line in a state in which the fifth switching unit is turned off and a second inspection operation in which in a state in which the fourth switching unit is turned on and the intermediate voltage is applied and precharged to the one pixel through the first column data line, an inspection signal is input from the second column data line to the other pixel, and then a signal is read out from the one pixel to the first column data line in a state in which the fourth switching unit is turned off, on all of the plurality of pixels in a unit of pixels in each rows in the inspection of the pixels.

4. The liquid crystal display device according to claim 2, further comprising:

an intermediate voltage generating unit configured to generate an intermediate voltage that is a set voltage at a center voltage or less in a power supply voltage range;

a fourth switching unit configured to be connected between a first column data line connected to one pixel of the two pixels in each of the pairs and the intermediate voltage generating unit; and a fifth switching unit configured to be connected between a second column data line connected to the other pixel of the two pixels in each of the pairs and the intermediate voltage generating unit, wherein the inspection control unit alternately performs a first inspection operation in which in a state in which the fifth switching unit is turned on and the intermediate voltage is applied and precharged to the other pixel through the second column data line, the third switching unit is turned on, an inspection signal is input from the first column data line to the one pixel, and then a signal is read out from the other pixel to the second column data line in a state in which the fifth switching unit is turned off and a second inspection operation in which in a state in which the fourth switching unit is turned on and the intermediate voltage is applied and precharged to the one pixel through the first column data line, the third switching unit is controlled to be turned on, an inspection signal is input from the second column data line to the other pixel, and then a signal is read out from the one pixel to the first column data line in a state in which the fourth switching unit is turned off, on all of the plurality of pixels in a unit of pixels in each rows in the inspection of the pixels.

5. A pixel inspection method for a liquid crystal display device including a plurality of pixels configured to be provided at an intersecting portion at which a plurality of column data lines intersects with a plurality of row scanning lines, in which two adjacent pixels that are connected to a same row scanning line are paired, each of the two pixels of each pairs individually including:

a display element configured to be filled and seal with liquid crystal between a pixel electrode and a common electrode opposite to each other;

a first switching unit configured to be connected to the row scanning line and configured to sample each subframe data for displaying each of a plurality of subframes having a display period shorter than one frame period of the video signal through the column data line when selecting a row, the plurality of subframes being for displaying one frame;

a first signal holding unit configured to form a static random access memory together with the first switching unit and configured to store the subframe data sampled by the first switching unit;

the display element, the first switching unit, and the first signal holding unit being provided separately in each of the pixels in the pair; and a second switching unit configured to connect or disconnect a connecting point between the first signal holding unit and the pixel electrode in the two pixels, the second switching unit being provided commonly in each of the pairs, in inspecting the pixels of the liquid crystal display device, the method comprising:

controlling the second switching unit to be turned on; and alternately performing a first inspection operation in which an inspection signal is input from a first column data line connected to one pixel of the two pixels in each of the pairs into the one pixel and is read out to a second column data line connected to another pixel through the other pixel of the two pixels in each of the pairs and a second inspection operation in which an inspection signal is input from the second column data line into the other pixel and is read out to the first column data line through the one pixel, on all of the plurality of pixels in a unit of pixels in each rows.

6. The pixel inspection method for a liquid crystal display device according to claim 5, wherein:

the two adjacent pixels that connected to the same row scanning line in each of the pairs further individually include:

a third switching unit configured to output the subframe data stored in the first signal holding unit; and a second signal holding unit configured to form a dynamic random access memory together with the third switching unit, in which stored content is rewritten with the subframe data stored on the first signal holding unit, the subframe data being supplied through the third switching unit, and configured to apply output data to the pixel electrode;

the third switching unit and the second signal holding unit are provided separately in each of the pixels in the pair;

the second switching unit is configured to connect or disconnect a connecting point between the second signal holding unit and the pixel electrode in the two pixels, in inspecting the pixels of the liquid crystal display device, the method comprising:

controlling the second switching unit to be turned on; and alternately performing a first inspection operation in which the third switching unit is controlled to be turned on, an inspection signal is input from a first column data line connected to one pixel of the two pixels in each of the pairs into the one pixel and is read out to a second column data line connected to another pixel through the other pixel of the two pixels in each of the pairs and a second inspection operation in which an inspection signal is input from the second column data line into the other pixel and is read out to the first column data line through the one pixel, on all of the plurality of pixels in a unit of pixels in each rows.

* * * * *